US010153115B2

(12) United States Patent
Takaya et al.

(10) Patent No.: US 10,153,115 B2
(45) Date of Patent: Dec. 11, 2018

(54) ELECTROMAGNETIC CONTACTOR

(71) Applicant: FUJI ELECTRIC FA COMPONENTS & SYSTEMS CO., LTD., Tokyo (JP)

(72) Inventors: Kouetsu Takaya, Kounosu (JP); Yuki Tashima, Kounosu (JP); Hideo Adachi, Fukaya (JP); Yasuhiro Naka, Kitamoto (JP); Koujun Konishi, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 15/459,096

(22) Filed: Mar. 15, 2017

(65) Prior Publication Data

US 2018/0197707 A1 Jul. 12, 2018

(30) Foreign Application Priority Data

Jan. 11, 2017 (JP) ..... 2017-002332

(51) Int. Cl.
*H01H 50/54* (2006.01)
*H01H 50/14* (2006.01)
(Continued)

(52) U.S. Cl.
CPC ..... *H01H 50/541* (2013.01); *H01H 50/02* (2013.01); *H01H 50/14* (2013.01); *H01H 50/20* (2013.01); *H01H 50/443* (2013.01)

(58) Field of Classification Search
CPC ..... H01H 50/18; H01H 50/02; H01H 50/54; H01H 50/14; H01H 50/443
(Continued)

(56) References Cited

U.S. PATENT DOCUMENTS 2,757,254 A * 7/1956 Wells ..... H01H 50/54 200/286
2,783,340 A * 2/1957 Davies ..... H01H 9/04 174/153 R
(Continued)

FOREIGN PATENT DOCUMENTS

JP S49-47135 U 4/1974
JP S50-044648 U 5/1975
(Continued)

OTHER PUBLICATIONS

Europe Patent Office, "Search Report for European Patent Application No. 17160992.8," dated Oct. 17, 2017.
(Continued)

*Primary Examiner* — Shawki S Ismail
*Assistant Examiner* — Lisa N Homza
(74) *Attorney, Agent, or Firm* — Manabu Kanesaka

(57) ABSTRACT

To provide an electromagnetic contactor that enables electrical connection work of connecting the electromagnetic contactor to another electrical component disposed in a current path to be performed easily and efficiently. An electromagnetic contactor includes a main contact portion; an auxiliary contact portion; a contact housing case that houses the main contact portion and the auxiliary contact portion; an electromagnet unit that drives a movable plunger coupled to a connecting shaft of the main contact portion; main contact electrodes project out of a case wall of the contact housing case to an outside; auxiliary contact electrodes that are connected to a pair of fixed contacts of the auxiliary contact portion and project out of the case wall to an outside; and an auxiliary contact external terminal portion that is connected to the auxiliary contact electrodes and is arranged on a portion of the case wall.

18 Claims, 22 Drawing Sheets

(51) Int. Cl.
*H01H 50/02* (2006.01)
*H01H 50/20* (2006.01)
*H01H 50/44* (2006.01)

(58) Field of Classification Search
USPC ..... 335/229
See application file for complete search history.

(56) References Cited

U.S. PATENT DOCUMENTS 3,339,161 A * 8/1967 Conner ..... H01H 50/22 200/243
3,368,171 A * 2/1968 Conner ..... H01H 50/323 335/120
3,590,357 A * 6/1971 Reid ..... H02J 7/1423 307/115
3,821,671 A * 6/1974 Grunert et al. ..... H01H 50/045 335/132
3,898,596 A * 8/1975 Richards ..... H01H 3/60 200/250
3,942,143 A * 3/1976 Pollmann ..... H01H 50/541 335/132
4,377,796 A * 3/1983 Grunert ..... H01H 51/06 335/131
4,899,120 A * 2/1990 Ohtake ..... H01H 9/0264 335/132
5,424,700 A * 6/1995 Santarelli ..... H01H 1/06 335/126
5,570,075 A 10/1996 Krimmer et al.
5,703,551 A * 12/1997 Lefebvre ..... H01H 51/065 335/126
5,892,422 A * 4/1999 Montaigu ..... H01H 51/065 335/126
6,049,263 A * 4/2000 Vilou ..... H01H 51/065 290/38 R
6,377,143 B1 * 4/2002 Zhou ..... H01H 50/546 218/154
6,411,189 B1 6/2002 Noda et al.
6,943,654 B2 * 9/2005 Zhou ..... H01H 9/563 335/106
7,196,434 B2 * 3/2007 Zhou ..... H01H 9/563 307/131
7,317,264 B2 * 1/2008 Kinsella ..... H01H 9/563 307/139
8,138,863 B2 * 3/2012 Tanaka ..... H01H 1/54 335/126
8,258,908 B2 * 9/2012 Liao ..... H01F 27/02 336/192
8,525,622 B2 * 9/2013 Kubono ..... H01H 50/14 335/199
8,847,713 B2 * 9/2014 Niimi ..... H01H 50/443 335/126
9,396,898 B2 * 7/2016 Kinsella ..... H01H 50/90
9,401,238 B2 * 7/2016 Mimura ..... H01F 5/04
9,590,536 B2 * 3/2017 Kinsella ..... H02P 1/26
9,673,008 B2 * 6/2017 Tachikawa ..... H01H 50/18
2004/0169976 A1 * 9/2004 Zhou ..... H01H 9/563 361/93.1
2008/0084260 A1 4/2008 Swartzentruber et al.
2013/0127571 A1 * 5/2013 Takaya ..... H01H 9/443 335/201
2015/0015350 A1 * 1/2015 Tachikawa ..... H01H 1/66 335/131
2015/0022292 A1 * 1/2015 Tachikawa ..... H01H 50/54 335/131
2015/0248983 A1 * 9/2015 De Barros Albuquerque ..... H01H 71/08 335/133
2016/0049273 A1 * 2/2016 Jang ..... H01H 47/10 335/192
2016/0079021 A1 * 3/2016 De Barros Albuquerque ..... H01H 50/02 335/202

FOREIGN PATENT DOCUMENTS

JP S57-152737 U 9/1982
JP S58-39007 A 3/1983
JP S64-2345 U 1/1989
JP H08-203407 A 8/1996
JP 2009-064738 A 3/2009
JP 2009-211831 A 9/2009
JP 2011-228060 A 11/2011
JP 2013-232341 A 11/2013

OTHER PUBLICATIONS

Japan Patent Office, "Office Action for Japanese Patent Application No. 2017-002332," dated Apr. 4, 2017.

* cited by examiner

ELECTROMAGNETIC CONTACTOR

CROSS REFERENCE TO RELATED APPLICATIONS AND INCORPORATION BY REFERENCE

This application claims benefit of priority under 35 USC 119 based on Japanese Patent Application No. 2017-002332 filed on Jan. 11, 2017, the entire contents of which are incorporated by reference herein.

TECHNICAL FIELD

The present invention relates to an electromagnetic contactor that performs opening and closing of a current path.

BACKGROUND ART

As an electromagnetic contactor that performs opening and closing of a current path, for example, an electromagnetic contactor described in US 2008/0084260 A1 has been conventionally known.

The electromagnetic contactor in US 2008/0084260 A1 includes a main contact mechanism that includes a pair of main fixed contacts and a main movable contact that is contactable with and separable from the pair of main fixed contacts, an auxiliary contact mechanism that operates in conjunction with the main movable contact, and an electromagnet unit that drives the main movable contact of the main contact mechanism.

The electromagnetic contactor in US 2008/0084260 A1 has a structure in which lead wires of the electromagnet unit and the auxiliary contact mechanism that are housed inside a device case are led out of a portion of the device case to the outside.

To connect the electromagnetic contactor in US 2008/0084260 A1 to another electrical component disposed in a current path, it is required to fit a terminal block and connection components such as a ferrule to the lead wires and to connect the connection components to lead wires of the another electrical component. For this reason, there is a problem in that the contact device in US 2008/0084260 A1 requires a large amount of effort and time for connection work of connecting another electrical component.

SUMMARY OF INVENTION

Accordingly, the present invention is made in consideration of the above-described circumstances, and an object of the present invention is to provide an electromagnetic contactor that enables electrical connection work of connecting the electromagnetic contactor to another electrical component disposed in a current path to be performed easily and efficiently.

In order to achieve the above-described object, according to an aspect of the present invention, there is provided an electromagnetic contactor including: a main contact portion; an auxiliary contact portion that operates in conjunction with the main contact portion; a contact housing case that houses the main contact portion and the auxiliary contact portion; an electromagnet unit that drives the main contact portion and the auxiliary contact portion; at least a pair of auxiliary contact electrodes that are connected to a pair of fixed contacts of the auxiliary contact portion and project out of a case wall to an outside; and an auxiliary contact external terminal portion that is connected to the auxiliary contact electrodes and is arranged on the case wall.

According to an electromagnetic contactor according to the present invention, it is possible to carryout electrical connection work of connecting the electromagnetic contactor to another electrical component disposed in a current path to be performed easily and efficiently.

The object and advantages of the invention will be realized and attained by means of the elements and combinations particularly pointed out in the claims. It is to be understood that both the foregoing general description and the following detailed description are exemplary and explanatory and are not restrictive of the invention.

DETAILED DESCRIPTION

Next, with reference to the accompanying drawings, first to ninth embodiments according to the present invention will be described. In the following description of the drawings, the same or similar reference signs are assigned to the same or similar composing elements. However, it should be noted that the drawings are schematic and relations between thicknesses and planar dimensions, ratios among thicknesses of respective layers, and the like are different from actual ones. Therefore, specific thicknesses and dimensions should be determined in consideration of the following description. It should also be noted that the drawings include portions having different dimensional relationships and ratios from each other.

In addition, the first to ninth embodiments, which will be described below, indicate devices and methods to embody the technical idea of the present invention, and the technical idea of the present invention does not limit the materials, shapes, structures, arrangements, and the like of the constituent components to those described below. The technical idea of the present invention can be subjected to a variety of alterations within the technical scope prescribed by the claims.

First Embodiment

Figure 1:
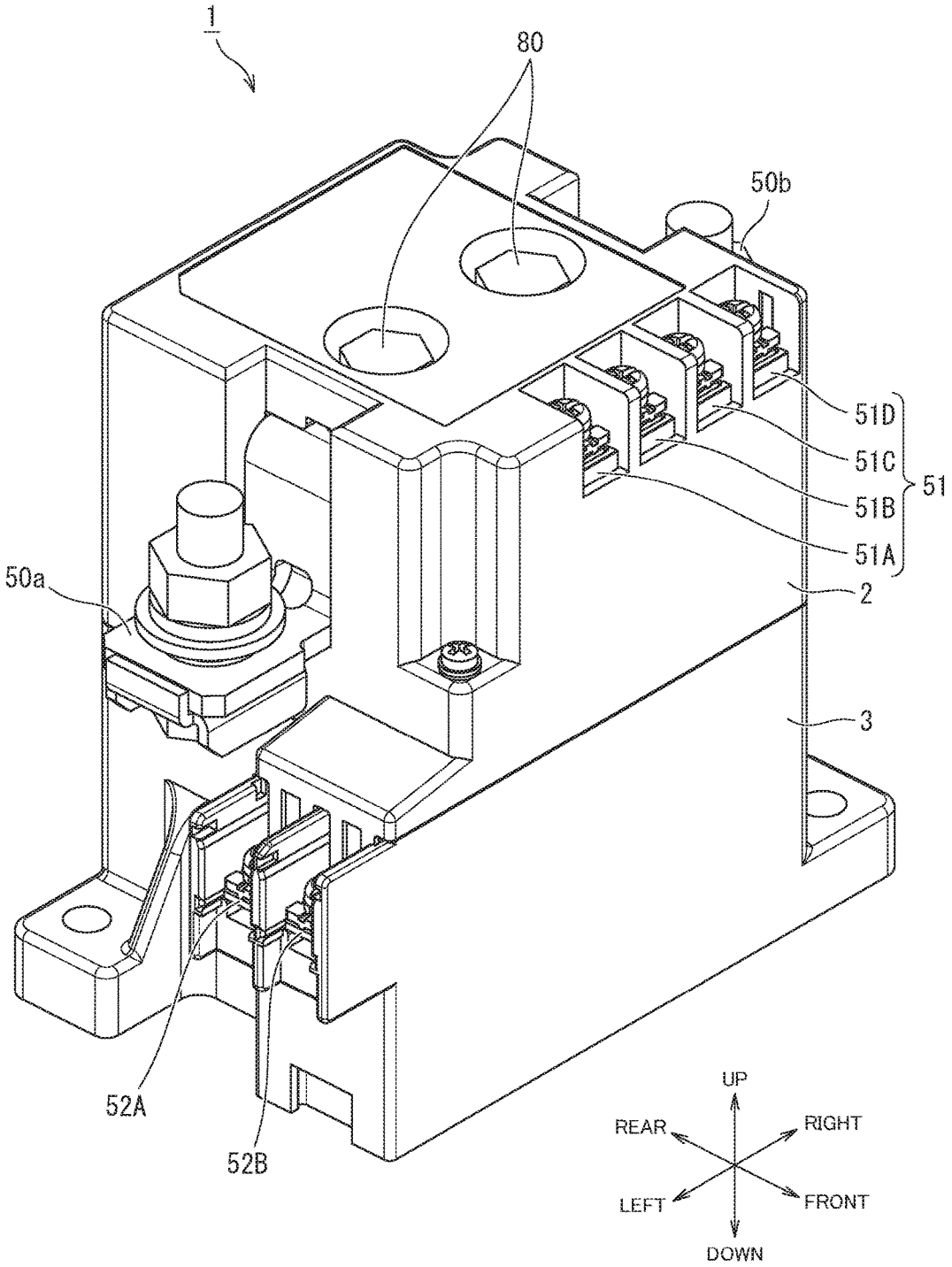
FIG. 1 is a perspective view illustrative of a first insulating case and a second insulating case that compose an electromagnetic contactor of a first embodiment according to the present invention.
Figure 2:
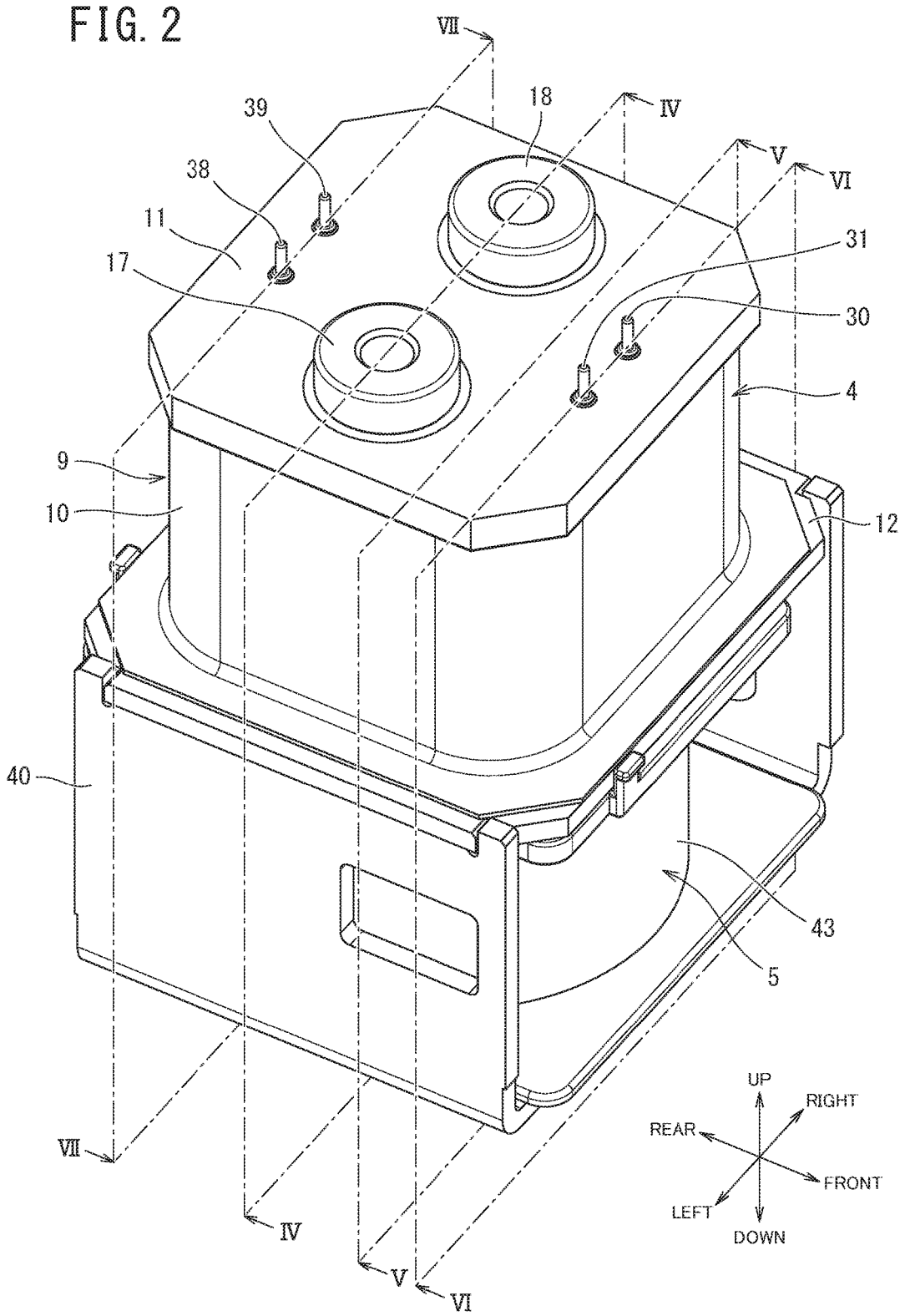
FIG. 2 is a perspective view illustrative of a contact device and an electromagnet unit housed inside the first insulating case and the second insulating case in the first embodiment.
Figure 10:
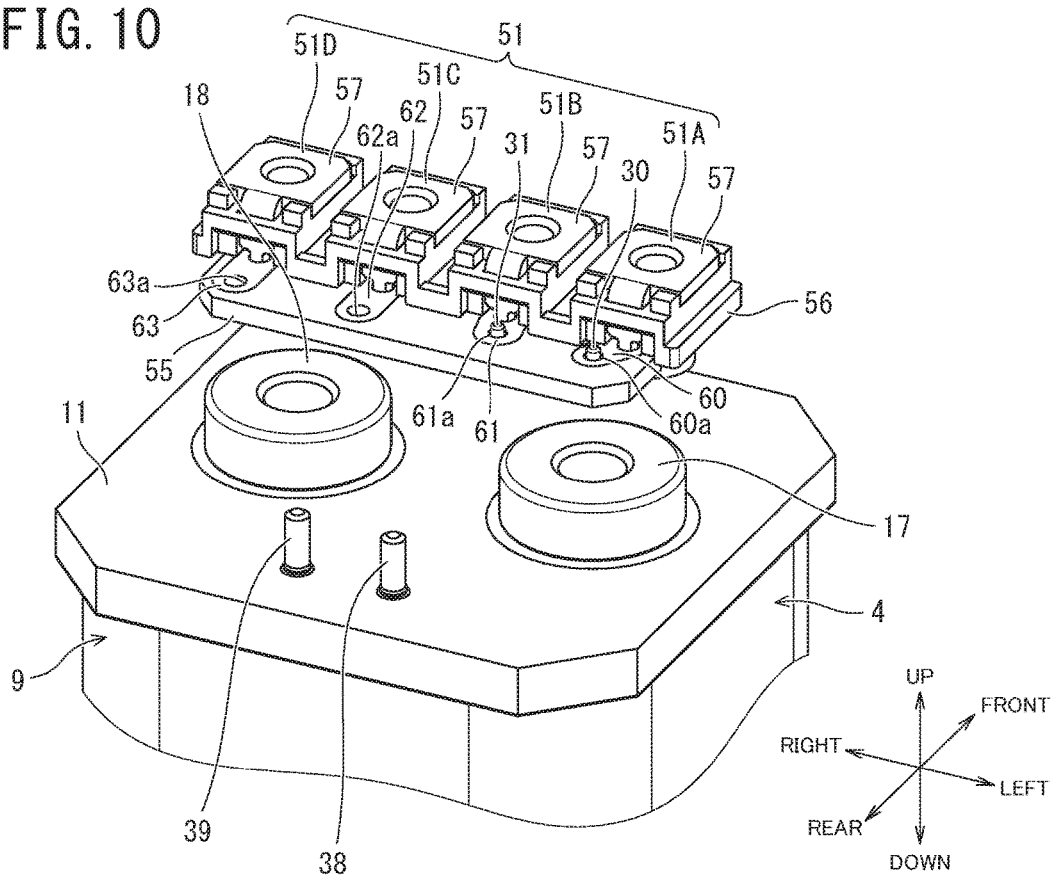
FIG. 10 is a perspective view illustrative of a state in which the auxiliary contact external terminal portion of the first embodiment is arranged on a case wall.
Figure 11:
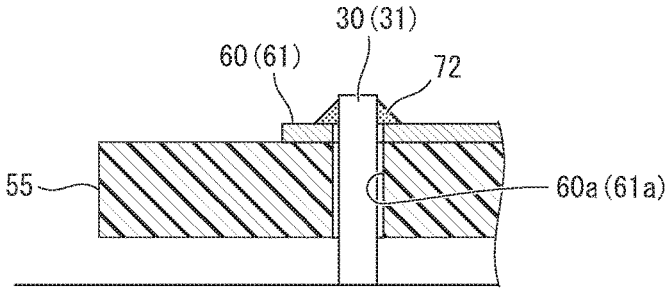
FIG. 11 is a cross-sectional view illustrative of a main portion of FIG. 10.
Figure 12:
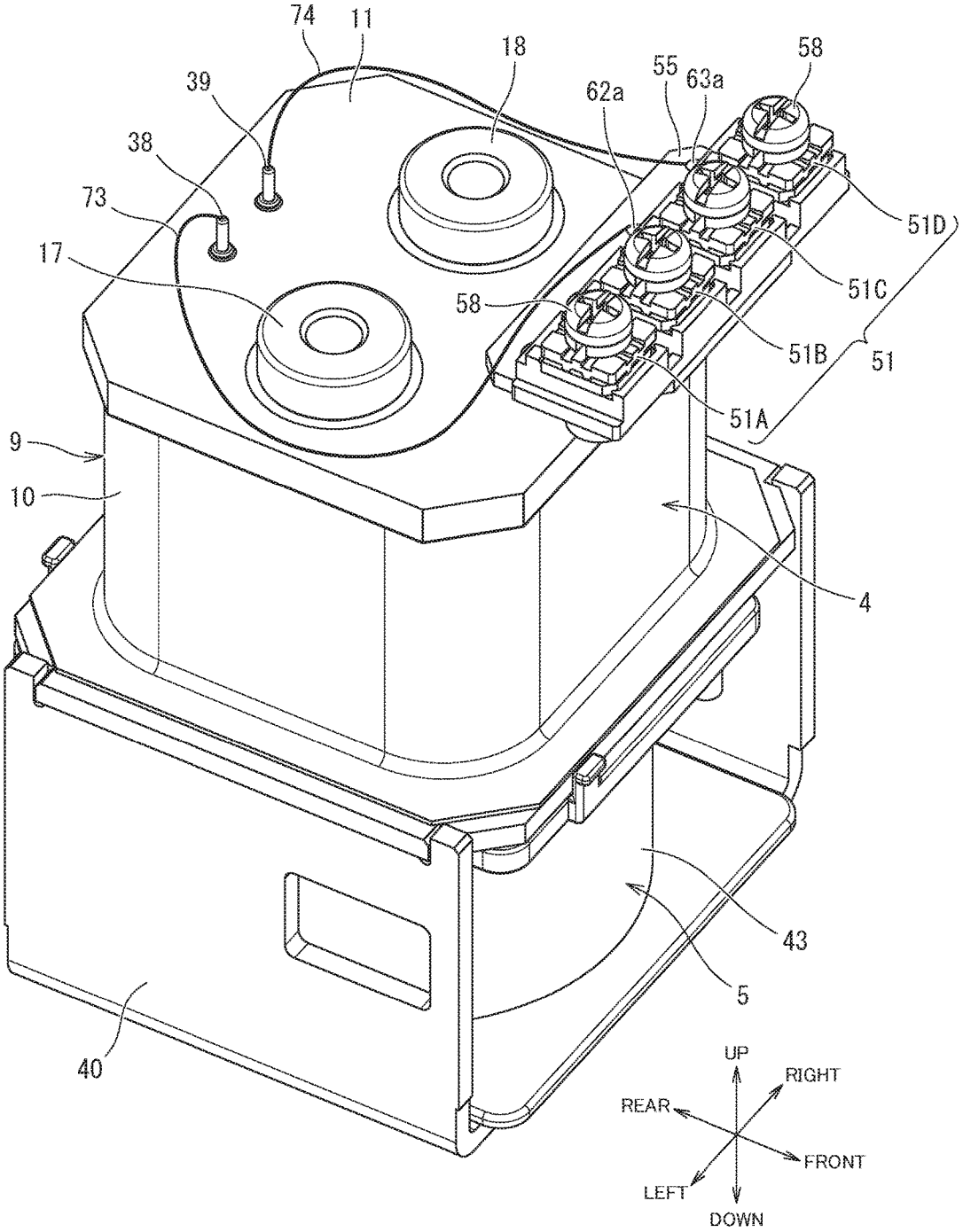
FIG. 12 is a diagram illustrative of a state in which the auxiliary contact external terminal portion of the first embodiment is connected to auxiliary contact electrodes.

With reference to FIGS. 1 to 12, an electromagnetic contactor 1 of a first embodiment will be described. The following description will be made assuming that the upside, the downside, the left side, the right side, the front side, and the rear side in FIGS. 1, 2, 1, and 12 are respectively indicated by "up", "down", "left", "right", "front", and "rear". Cross sections taken along the planes IV-IV, V-V, VI-VI, and VII-VII in FIG. 2 are respectively illustrated in FIGS. 4, 5, 6, and 7.

As illustrated in FIG. 1, the electromagnetic contactor 1 includes a first insulating case 2 and a second insulating case 3. Main contact external terminal portions 50*a* and 50*b* are arranged in a projecting state on the right and left side surfaces of the first insulating case 2, an auxiliary contact external terminal portion 51 is arranged on the front side of the first insulating case 2, and a pair of electromagnet unit external terminal portions 52A and 52B are arranged on the left side surface of the second insulating case 3. In the above configuration, the auxiliary contact external terminal portion 51 is made up of a pair of first auxiliary contact external terminal portions 51A and 51B and a pair of second auxiliary contact external terminal portions 51C and 51D, which will be described later.

A portion illustrated in FIG. 2 contains a contact device 4 and an electromagnet unit 5 that drives the contact device 4, which are housed in the first insulating case 2 and the second insulating case 3.

Figure 3:
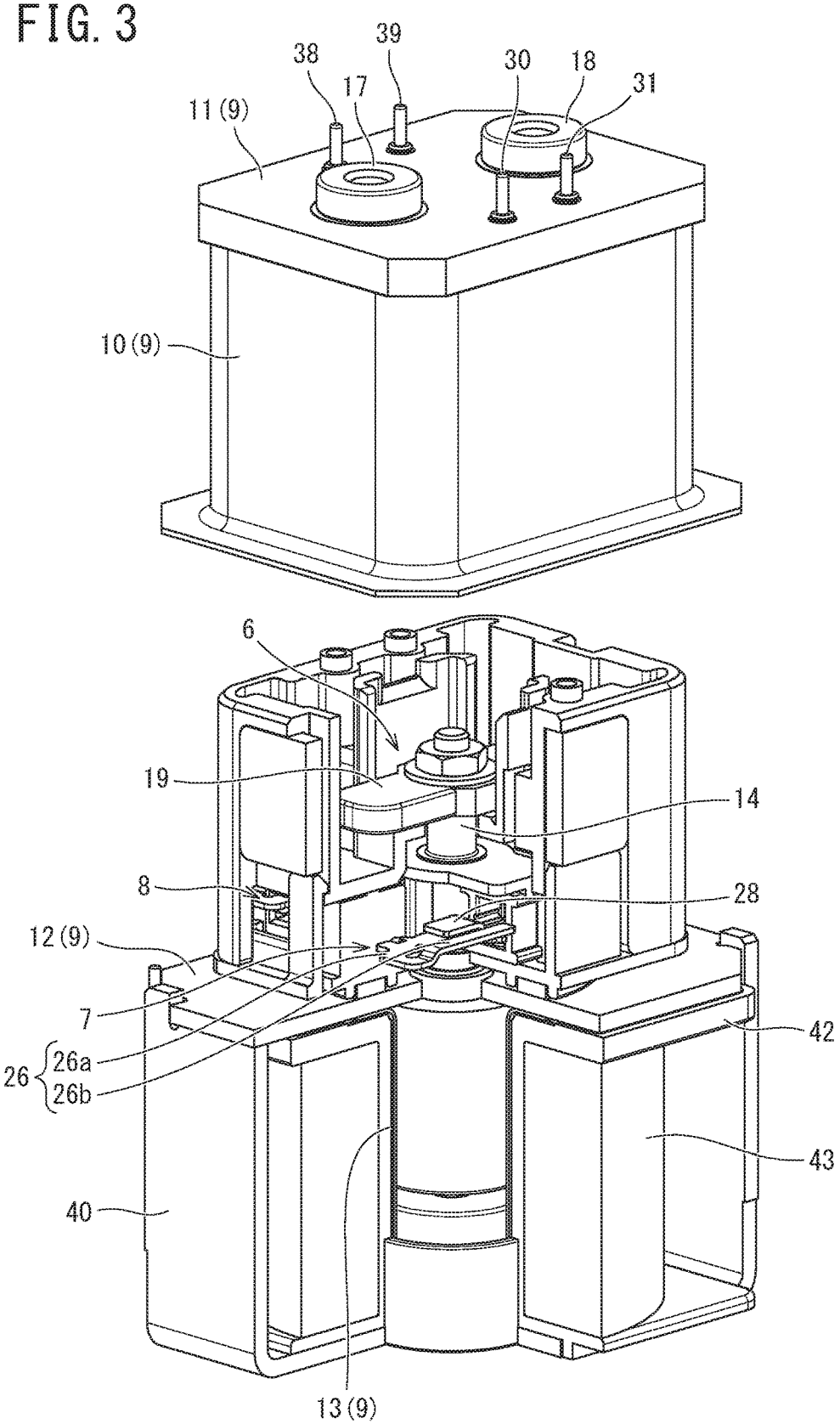
FIG. 3 is a diagram illustrative of an internal structure of the contact device of the first embodiment.
Figure 4:
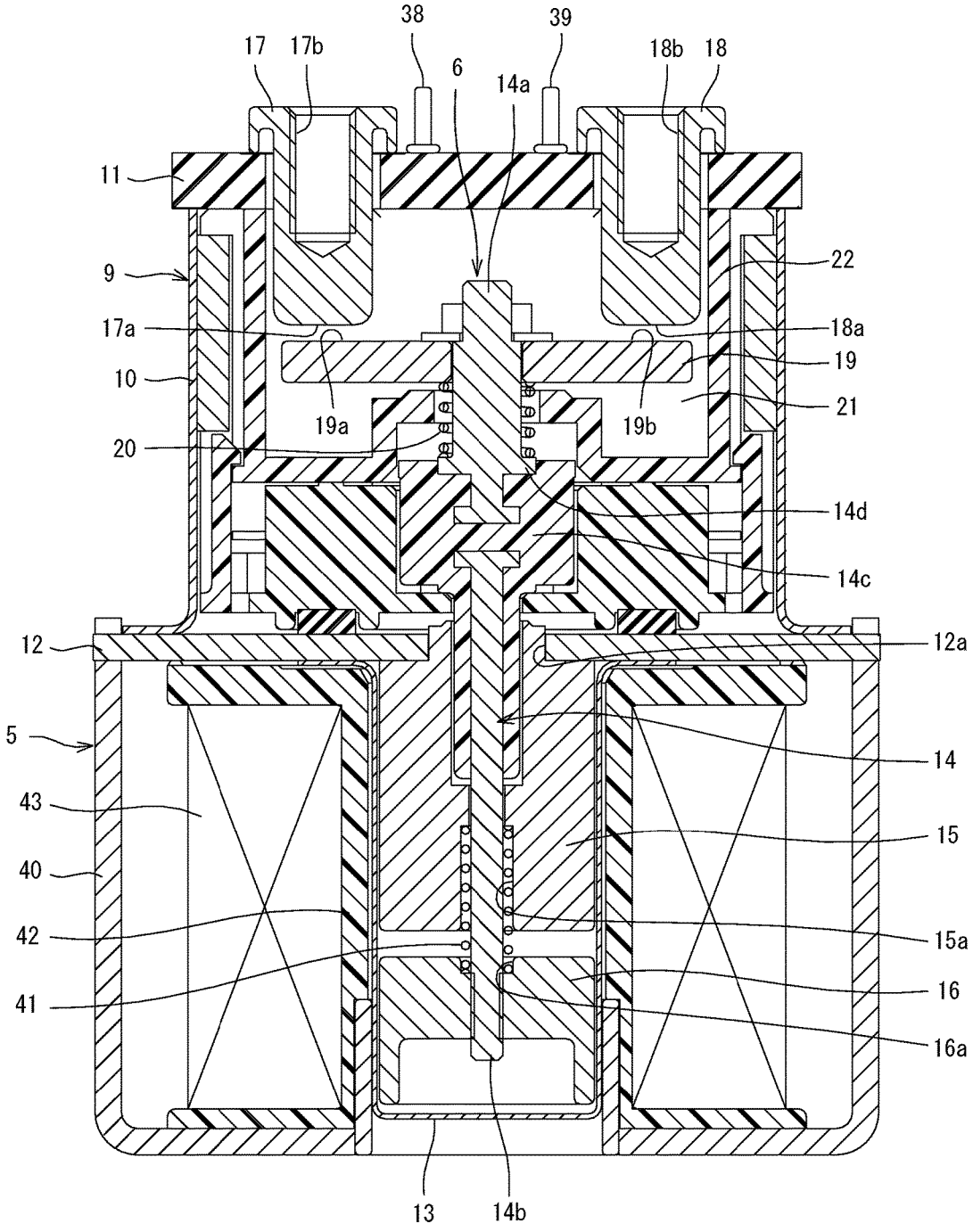
FIG. 4 is a diagram illustrative of a cross section taken along the plane IV-IV in FIG. 2.

The contact device 4 includes a main contact mechanism 6, first and second auxiliary contact mechanisms 7 and 8 that operate in conjunction with the main contact mechanism 6, and a housing case 9, as illustrated in FIGS. 3 and 4.

The housing case 9 is made up of a joining member 10 that has polygonal tubular shape and is made of metal, a top plate 11 that is joined to an upper end portion of the joining member 10 to close the upper side of the joining member 10 and is made of ceramic, a magnetic yoke 12 the upper surface of which is seal-joined to a lower end portion of the joining member 10 and that has a flat plate shape, and a cap 13 that is seal-joined to the lower surface of the magnetic yoke 12, has a cylindrical shape, and is made of metal.

Inside the housing case 9, the main contact mechanism 6, the first and second auxiliary contact mechanisms 7 and 8, and a connecting shaft 14, a fixed iron core 15, and a movable plunger 16 of the electromagnet unit 5 are housed in a sealed state and arc-extinguishing gas is enclosed.

The main contact mechanism 6 includes a pair of main fixed contacts 17 and 18 that are fixed to the top plate 11 and a main movable contact 19 that is contactable with and separable from the pair of main fixed contacts 17 and 18, as illustrated in FIG. 4. The main fixed contacts 17 and 18 are formed of a conductive metal material and fixed to the top plate 11 of the housing case 9 while being separated from each other at a predetermined distance in the right-left direction. On the lower end surfaces of the main fixed contacts 17 and 18, contact portions 17*a* and 18*a* are formed.

The aforementioned main contact external terminal portions 50*a* and 50*b* are arranged in a projecting state from the right and left side surfaces of the first insulating case 2 by screwing captive screws 80 (see FIG. 1) to female screws 17*b* and 18*b* formed in upper portions of the main fixed contacts 17 and 18, respectively.

The main movable contact 19 is a conductive plate that is made of a conductive metal material and extends long in the right-left direction and is supported by the connecting shaft 14, which is fixed to the movable plunger 16 of the electromagnet unit 5, in an upwardly and downwardly movable manner. A contact portion 19*a* that comes into contact with the contact portion 17*a* of the main fixed contact 17 is formed on the upper surface of the left end side portion of the main movable contact 19, and a contact portion 19*b* that comes into contact with the contact portion 18*a* of the main fixed contact 18 is formed on the upper surface of the right end side portion of the main movable contact 19.

The connecting shaft 14 is made up of a first connecting shaft 14*a* that is fixed to the main movable contact 19, a second connecting shaft 14*b* that is fixed to the movable plunger 16, and a shaft coupling member 14*c* that fixes the first connecting shaft 14*a* and the second connecting shaft 14*b* coaxially.

On a portion of the first connecting shaft 14*a* lower than the main movable contact 19, a flange portion 14*d* is formed in an outwardly protruding manner, and, between the flange portion 14*d* and the main movable contact 19, a contact spring 20 that biases the main movable contact 19 upward is fitted.

The main contact mechanism 6 is housed in a main contact mechanism housing chamber 21 that is formed inside the housing case 9. In the main contact mechanism housing chamber 21, an arc-extinguishing container 22 that is made of an insulator is arranged.

Figure 5:
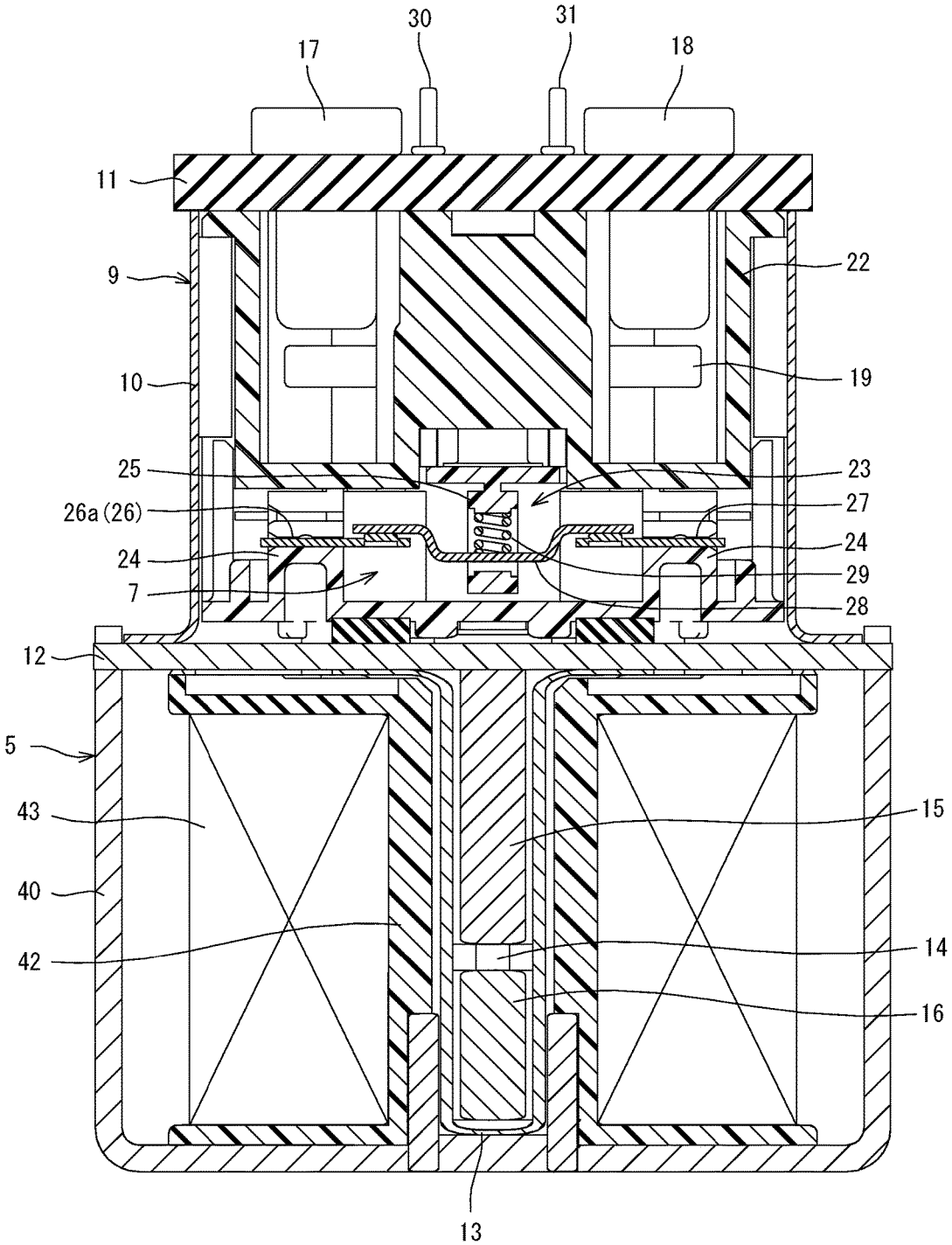
FIG. 5 is a diagram illustrative of a cross section taken along the plane V-V in FIG. 2.
Figure 7:
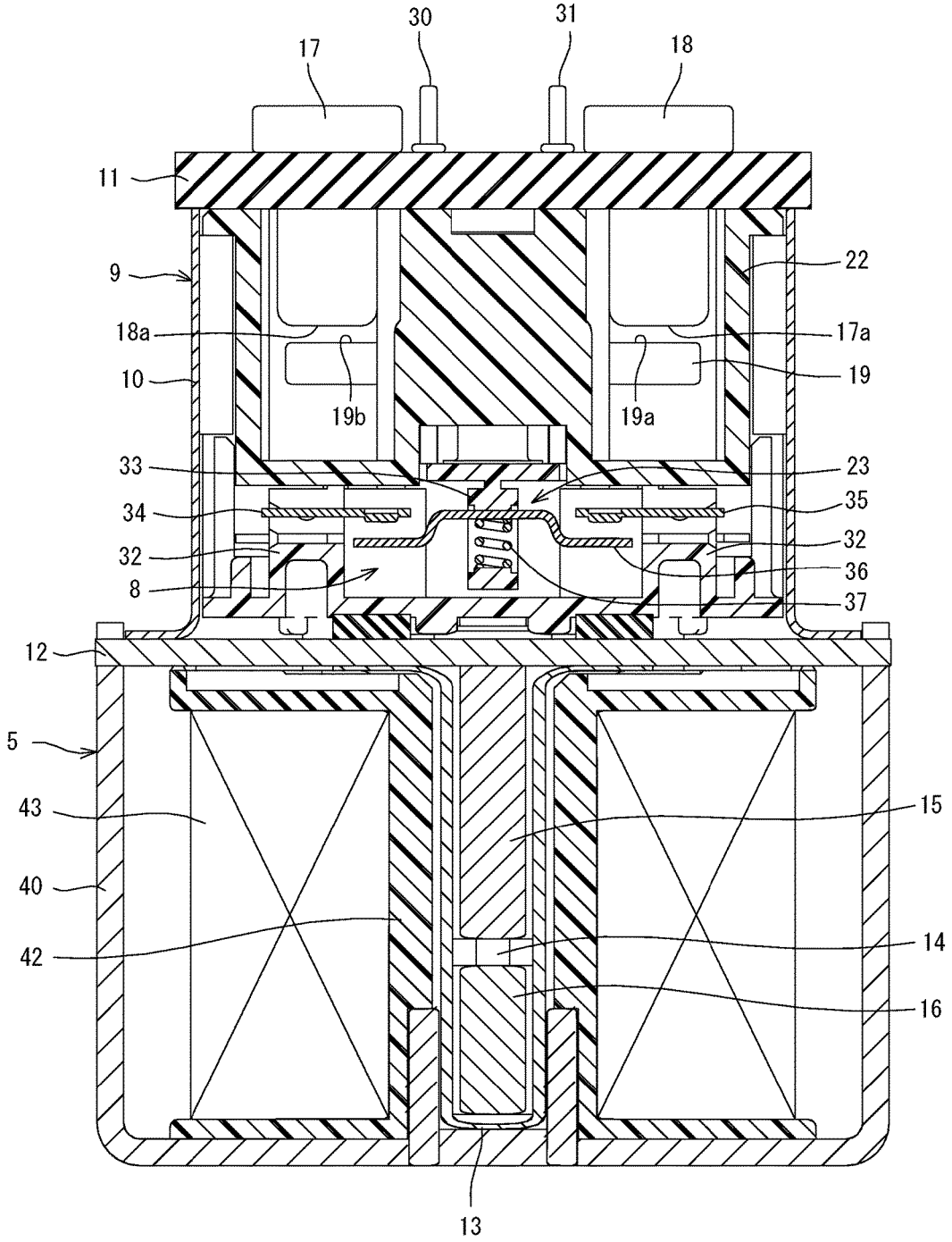
FIG. 7 is a diagram illustrative of a cross section taken along the plane VII-VII in FIG. 2.

As illustrated in FIGS. 5 and 7, under the arc-extinguishing container 22 of the main contact mechanism 6, an auxiliary contact mechanism housing chamber 23 that houses the first and second auxiliary contact mechanisms 7 and 8 in a separated state from the main contact mechanism 6 is formed.

The first auxiliary contact mechanism 7 includes a first auxiliary fixed contact support members 24 and 24 that are disposed in a separated manner in the right-left direction inside the auxiliary contact mechanism housing chamber 23, a first auxiliary movable contact support member 25 that is located between the first auxiliary fixed contact support members 24 and 24 and moves upward and downward in conjunction with the shaft coupling member 14*c* of the connecting shaft 14, a pair of first auxiliary fixed contacts 26 and 27 that are fixed to the first auxiliary fixed contact support members 24 and 24, and a first auxiliary movable contact 28 that is supported by the first auxiliary movable contact support member 25 and both end portions of which in the longitudinal direction face the pair of first auxiliary fixed contacts 26 and 27, as illustrated in FIG. 5. The first auxiliary contact mechanism 7 also includes a biasing spring 29 that is arranged on the first auxiliary movable contact support member 25 and provides the first auxiliary movable contact 28 with a biasing force and a pair of first auxiliary contact electrodes 30 and 31 that have rod shapes and are connected to the pair of first auxiliary fixed contacts 26 and 27, respectively.

Figure 6:
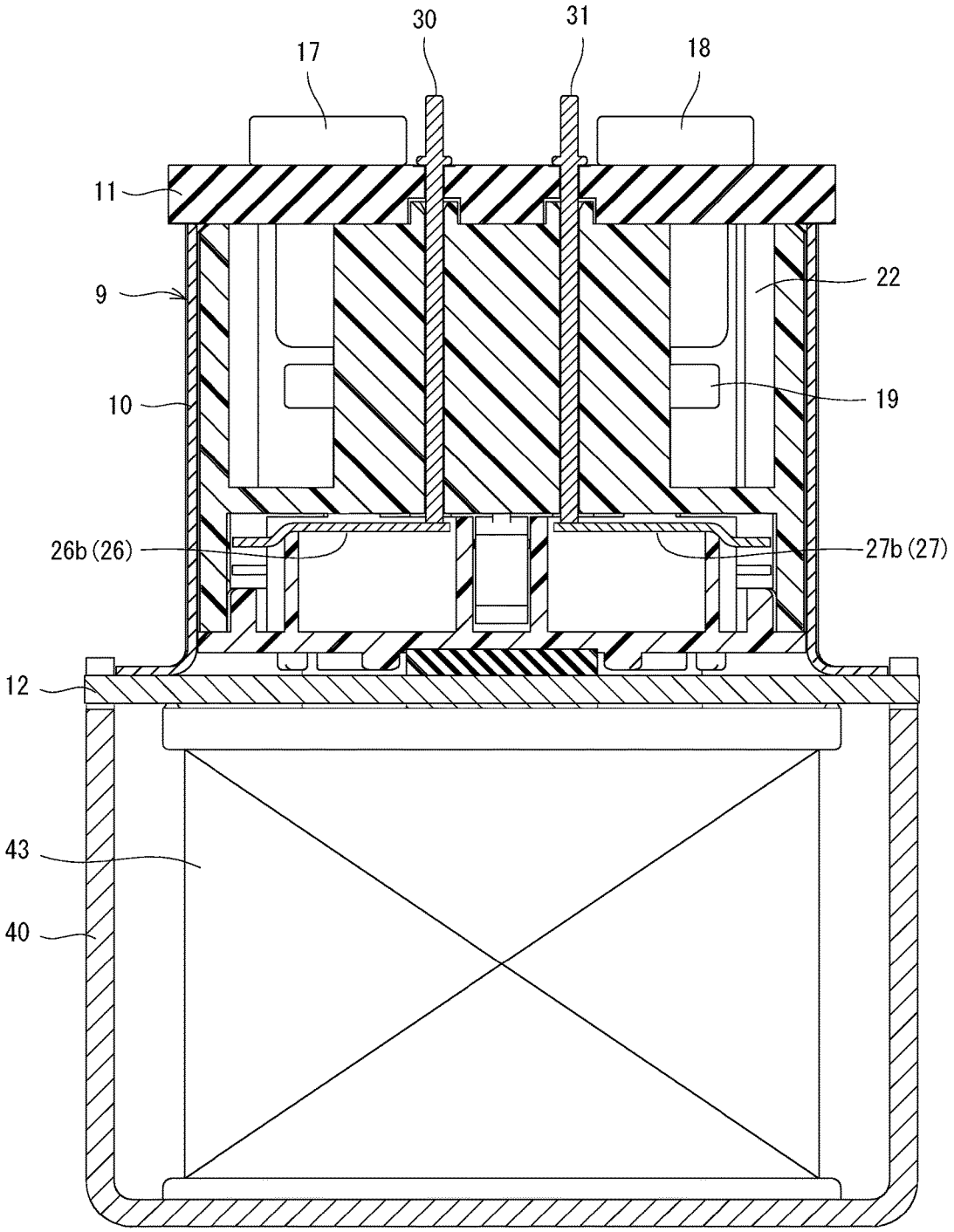
FIG. 6 is a diagram illustrative of a cross section taken along the plane VI-VI in FIG. 2.

The first auxiliary fixed contact 26 is a U-shaped member that includes a contact plate 26*a* on which a contact portion facing the first auxiliary movable contact 28 is formed and an electrode connection plate 26*b* that extends in parallel with the contact plate 26*a* as viewed in plan, as also illustrated in FIG. 3. As illustrated in FIG. 6, the lower end of the first auxiliary contact electrode 30 is connected to the electrode connection plate 26*b* of the first auxiliary fixed contact 26, and the first auxiliary contact electrode 30 extends upward and penetrates the top plate 11, to which the main fixed contacts 17 and 18 are fixed, on the front side (see FIG. 2) to project to the outside.

Moreover, the first auxiliary fixed contact 27 has the same shape as that of the first auxiliary fixed contact 26, the lower end of the first auxiliary contact electrode 31 is connected to an electrode connection plate 27*b* of the first auxiliary fixed contact 27, and the first auxiliary contact electrode 31 extends upward and penetrates the top plate 11 on the front side to project to the outside along beside the first auxiliary contact electrode 30.

The first auxiliary fixed contacts 26 and 27 and first auxiliary movable contact 28 of the first auxiliary contact mechanism 7 compose a form B contact (Normally-Close type contact), and, when the main movable contact 19 is in a released state, contact portions at both ends in the longitudinal direction of the first auxiliary movable contact 28 come into contact with the respective contact portions of the first auxiliary fixed contacts 26 and 27 with a predetermined contact force provided from the biasing spring 29. When the main movable contact 19 is put in a closed state, the first auxiliary movable contact 28 moves upward and the contact portions at both ends in the longitudinal direction are brought to an upwardly separated state from the contact portions of the first auxiliary fixed contacts 26 and 27 with a predetermined distance kept therebetween.

The second auxiliary contact mechanism 8 includes a second auxiliary fixed contact support members 32 and 32 that are disposed in a separated manner in the right-left direction inside the auxiliary contact mechanism housing chamber 23, a second auxiliary movable contact support member 33 that is located between the second auxiliary fixed contact support members 32 and 32 and moves upward and downward in conjunction with the shaft coupling member 14*c* of the connecting shaft 14, a pair of second auxiliary fixed contacts 34 and 35 that are fixed to the second auxiliary fixed contact support members 32 and 32, a second auxiliary movable contact 36 that is supported by the second auxiliary movable contact support member 33 and both end portions of which in the longitudinal direction face the pair of second auxiliary fixed contacts 34 and 35, a biasing spring 37 that is arranged on the second auxiliary movable contact support member 33 and provides the second auxiliary movable contact 36 with a biasing force, and second auxiliary contact electrodes 38 and 39 that have rod shapes and are connected to the pair of second auxiliary fixed contacts 34 and 35 by way of electrical connection portions (not illustrated), respectively, as illustrated in FIG. 7.

The second auxiliary fixed contacts 34 and 35 are U-shaped members that include contact plates (not illustrated) and electrode connection plates (not illustrated), which are the same as those of the first auxiliary fixed contacts 26 and 27, and the lower ends of the second auxiliary contact electrodes 38 and 39 are connected to the electrode connection plates of the second auxiliary fixed contacts 34 and 35, respectively, and the second auxiliary contact electrodes 38 and 39 extend upward and penetrate the top plate 11 on the rear side to project to the outside (see FIG. 2).

The second auxiliary fixed contacts 34 and 35 and second auxiliary movable contact 36 of the second auxiliary contact mechanism 8 compose a form A contact (Normally-Open type contact), and, when the main movable contact 19 is in a released state, contact portions at both ends in the longitudinal direction of the second auxiliary movable contact 36 are put in an upwardly separated state from contact portions of the second auxiliary fixed contacts 34 and 35 with a predetermined distance kept therebetween. When the main movable contact 19 is put in a closed state, the second auxiliary movable contact 36 moves upward and the contact portions thereof come into contact with the respective contact portions of the second auxiliary fixed contacts 34 and 35 with a predetermined contact force provided from the biasing spring 37.

The electromagnet unit 5 includes a lower magnetic yoke 40 that is U-shaped as viewed from the side, as illustrated in FIG. 4. To the upper end, which is an open end, of the lower magnetic yoke 40, the magnetic yoke 12, which is flat plate shaped, is fixed. At a central portion of the magnetic yoke 12, a through hole 12*a* is formed.

At a central portion of the lower surface of the magnetic yoke 12, the cap 13, which has a bottomed cylindrical shape, is seal-joined in such a way as to encircle the through hole 12*a*.

In the cap 13, the fixed iron core 15, which is fixed to the through hole 12*a* of the magnetic yoke 12 and has a cylindrical shape, is arranged and, under the fixed iron core 15, the movable plunger 16 is arranged in an upwardly and downwardly movable manner.

To the fixed iron core 15, a return spring housing recessed portion 15*a* that is recessed upward from the lower end surface of the fixed iron core is formed. To the movable plunger 16, a return spring housing recessed portion 16*a* that is recessed downward from the upper end surface of the movable plunger 16 is formed. Inside the return spring housing recessed portions 15*a* and 16*a*, a return spring 41 that constantly biases the movable plunger 16 downward is housed.

On the outer periphery of the cap 13, a spool 42 is arranged, and, around the outer periphery of the spool 42, an excitation coil 43 that drives the movable plunger 16 is wound.

The two ends of the winding of the excitation coil 43 are connected to the electromagnet unit external terminal portions 52A and 52B, which is illustrated in FIG. 1, respectively.

Figure 8:
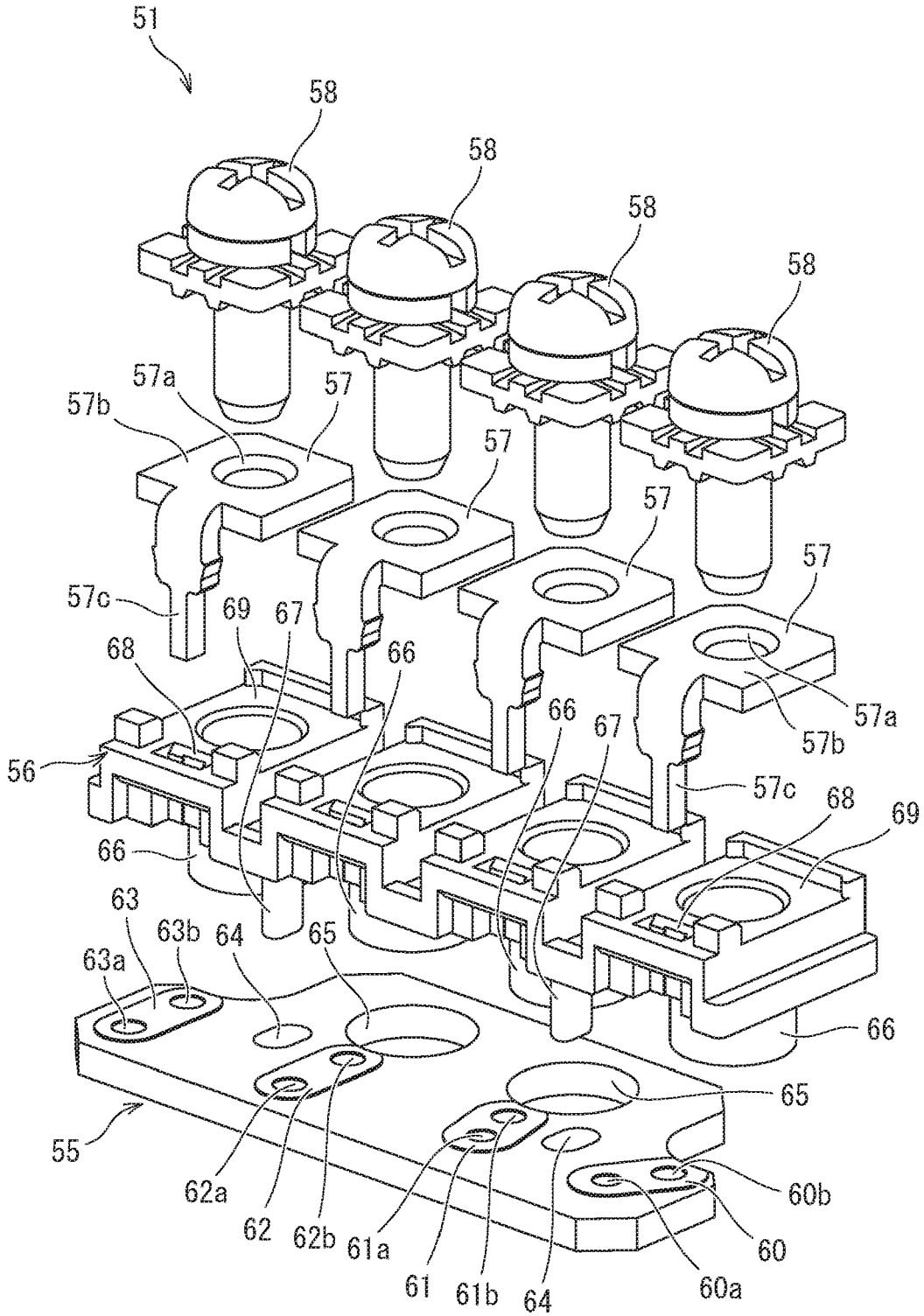
FIG. 8 is a diagram illustrative of a configuration of an auxiliary contact external terminal portion of the first embodiment.
Figure 9A:
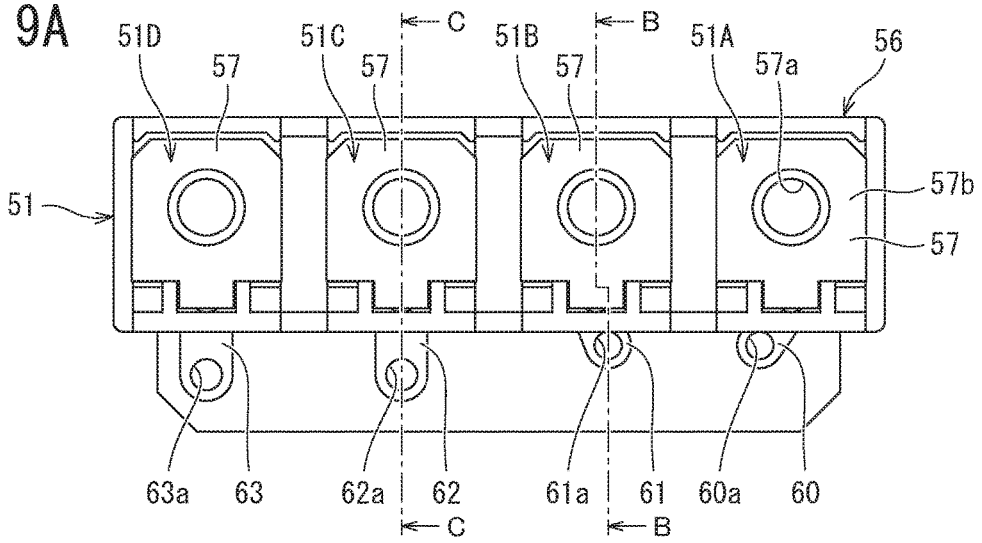
FIGS. 9A to 9C are diagrams illustrative of a plan view and cross sections of a main portion of the auxiliary contact external terminal portion of the first embodiment.
Figure 9B:
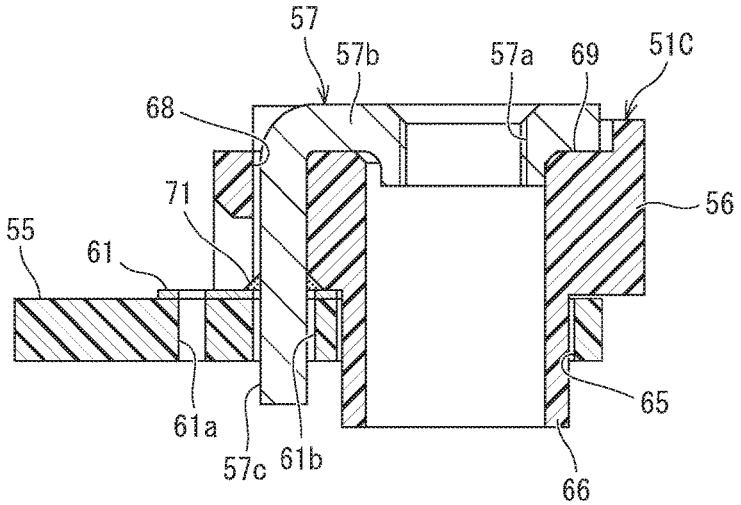
Figure 9C:
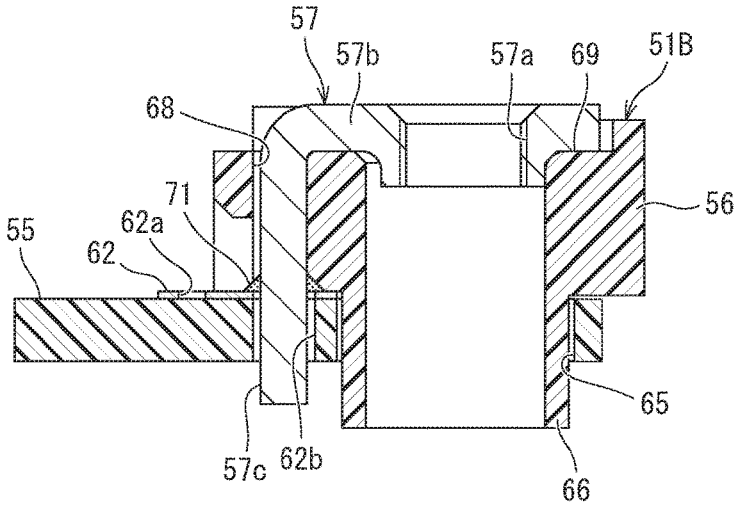

On the other hand, the auxiliary contact external terminal portion 51, which is arranged on the side surface on the front side of the first insulating case 2 in FIG. 1, includes a wiring board 55, a terminal block 56, four terminals 57, and four terminal screws 58 with a washer, as illustrated in FIGS. 8 and 9A. In FIG. 9A, the terminal screws 58 are omitted.

The wiring board 55 is a substantially rectangular board that is, for example, formed by impregnating glass fibers with epoxy resin and the like, and the wiring patterns 60 to 63 are formed at four locations on the upper surface of the wiring board 55, which locations are separated from one another along the longitudinal direction of the wiring board 55. On two wiring patterns 60 and 61 that are formed adjacent to each other on the right side of FIG. 8, electrode passage holes 60*a* and 61*a* that penetrate to the lower surface of the wiring board 55 and terminal passage holes 60*b* and 61*b* that penetrate to the lower surface of the wiring board 55 are formed separated from each other, respectively. On the other two wiring patterns 62 and 63 adjacent to each other on the left side of FIG. 8, lead wire connection holes 62*a* and 63*a* and terminal passage holes 62*b* and 63*b* are formed separated from each other, respectively. On the wiring board 55, small-diameter through holes 64 at two locations and large-diameter through holes 65 at two locations that are to be engaged with the terminal block 56 are also formed.

Each of the four terminals 57 includes a terminal plate 57*b* that has a square plate shape and on which a threaded hole 57*a* into which one of the terminal screws 58 is screwed is formed and a connection piece 57*c* that extends bent at a substantially right angle from the terminal plate 57*b*.

On a lower portion of the terminal block 56, four cylindrical large-diameter legs 66 are formed along the longitudinal direction with a predetermined distance between adjacent ones thereof, and two small-diameter legs 67 are formed in a separated manner in the longitudinal direction. On an upper portion of the terminal block 56, connection piece press-fit holes 68 through which the connection pieces 57*c* of the terminals 57 are made to pass are formed at four locations along the longitudinal direction with a predetermined distance between adjacent ones thereof, and, at four locations corresponding to the respective connection piece press-fit holes 68, four terminal plate support surfaces 69 with which the lower surfaces of the terminal plates 57*b* come into surface contact are formed.

Assembly of the auxiliary contact external terminal portion 51 is carried out as follows. First, by inserting the two small-diameter legs 67 and two large-diameter legs 66 of the terminal block 56 illustrated in FIG. 8 into the small-diameter through holes 64 at two locations and large-diameter through holes 65 at two locations of the wiring board 55, respectively, the terminal block 56 is engaged with the wiring board 55. Next, the connection pieces 57*c* of four terminals 57 are press-fitted through the connection piece press-fit hole 68 at four locations of the terminal block 56 and are subsequently inserted into the insides of the terminal passage holes 60*b*, 61*b*, 62*b*, and 63*b* at four locations of the wiring board 55, respectively, and the respective connection pieces 57*c* and the peripheries of the openings of the terminal passage holes 60*b*, 61*b*, 62*b*, and 63*b* are soldered together, respectively (referring to FIGS. 9B and 9C, soldered portions are referred to as soldered portions 71). Performing the above steps causes four terminals 57 and the wiring patterns 60 to 63, formed on the wiring board 55, to be electrically connected to each other, respectively.

Subsequently, screwing the terminal screws 58 into the threaded holes 57*a* of four terminals 57 completes the assembly of the auxiliary contact external terminal portion 51.

The auxiliary contact external terminal portion 51 with the above-described configuration is arranged on the front side of the top plate 11 of the housing case 9, to which the main fixed contacts 17 and 18 of the main contact mechanism 6 are fixed, and is connected to the first auxiliary contact electrodes 30 and 31, which project on the front side of the top plate 11, and the second auxiliary contact electrodes 38 and 39, which project on the rear side of the top plate 11, as illustrated in FIG. 10.

That is, the first auxiliary contact electrodes 30 and 31, which project on the front side of the top plate 11 of the housing case 9, are respectively inserted into the electrode passage holes 60*a* and 61*a*, which are formed in the wiring patterns 60 and 61 of the wiring board 55, from underneath. Subsequently, as illustrated in FIG. 11, the first auxiliary contact electrodes 30 and 31 and the peripheries of the openings of the electrode passage holes 60*a* and 61*a* are soldered together, respectively (soldered portions are referred to as soldered portions 72).

As illustrated in FIG. 12, to the second auxiliary contact electrodes 38 and 39, which project on the rear side of the top plate 11, one ends of two lead wires 73 and 74 are connected, respectively. The other end of the lead wire 73 is inserted into the lead wire connection hole 62*a*, which is formed in the wiring pattern 62 of the wiring board 55, and soldered. The other end of the lead wire 74 is also inserted into the lead wire connection hole 63*a*, which is formed in the wiring pattern 63 of the wiring board 55, and soldered.

Therefore, as illustrated in FIGS. 10 and 12, a pair of combinations of a terminal 57 and a terminal screw 58 on the right side that compose the auxiliary contact external terminal portion 51 are used as the first auxiliary contact external terminal portions 51A and 51B that serve as the external terminals of the first auxiliary contact mechanism 7, and a pair of combinations of a terminal 57 and a terminal screw 58 on the left side of the auxiliary contact external terminal portion 51 are used as the second auxiliary contact external terminal portions 51C and 51D that serve as the external terminals of the second auxiliary contact mechanism 8.

Housing the contact device 4 and the electromagnet unit 5 illustrated in FIG. 12 in the first insulating case 2 and the second insulating case 3 causes a pair of the first auxiliary contact external terminal portions 51A and 51B and a pair of the second auxiliary contact external terminal portions 51C and 51D, which are fixed to the top plate 11 of the housing case 9, to be arranged in an exposed state from a terminal opening portion (not illustrated) that is formed on the front side of the first insulating case 2 to the outside, as illustrated in FIG. 1.

In the above description, a housing case according to the present invention corresponds to the housing case 9, a case wall according to the present invention corresponds to the top plate 11, main contact electrodes according to the present invention that project out of the case wall to the outside correspond to the main fixed contacts 17 and 18, and a movable shaft according to the present invention corresponds to the connecting shaft 14.

Next, an operation of the electromagnetic contactor 1 of the first embodiment will be described.

It is assumed that the main contact external terminal portions 50*a* and 50*b* of the main contact mechanism 6 are, for example, respectively connected to a power supply source that supplies a large current and a load device.

It is also assumed that a first operation detection device (not illustrated) is connected to the pair of first auxiliary contact external terminal portions 51A and 51B, which are arranged on the front side of the first insulating case 2, and a second operation detection device (not illustrated) is connected to the pair of second auxiliary contact external terminal portions 51C and 51D, which are arranged along beside the pair of first auxiliary contact external terminal portions 51A and 51B.

It is still also assumed that an electromagnet unit control device (not illustrated) that performs energization control for the excitation coil 43 is connected to the electromagnet unit external terminal portions 52A and 52B.

It is assumed that, as illustrated in FIG. 4, the excitation coil 43 of the electromagnet unit 5 is in a non-excited state and the electromagnet unit 5 is in a released state in which the electromagnet unit 5 is not generating an excitation force elevating the movable plunger 16.

In this released state, the movable plunger 16 is biased downward by the return spring 41. Thus, the main movable contact 19 of the main contact mechanism 6, which is coupled to the movable plunger 16 by way of the connecting shaft 14, is separated downward from the pair of main fixed contacts 17 and 18 by a predetermined distance. For this reason, the current path between the pair of main fixed contacts 17 and 18 is put in a cutoff state and the main contact mechanism 6 is in an open state.

At this time, with regard to the first auxiliary contact mechanism 7, since the movable plunger 16 is biased downward by the return spring 41 and the connecting shaft 14 coupled to the movable plunger 16 has also moved to a lower position, the first auxiliary movable contact 28 comes into contact with the first auxiliary fixed contacts 26 and 27 and the first operation detection device confirms continuity between the first auxiliary contact external terminal portions 51A and 51B. On the other hand, with regard to the second auxiliary contact mechanism 8, since the second auxiliary movable contact 36 is separated from the second auxiliary fixed contacts 34 and 35, the second operation detection device confirms non-continuity between the second auxiliary contact external terminal portions 51C and 51D.

When the excitation coil 43 of the electromagnet unit 5 is energized by the electromagnet unit control device while the electromagnet unit 5 is in the released state, an excitation force is generated in the electromagnet unit 5 and pushes the movable plunger 16 upward resisting against a biasing force from the return spring 41.

When the movable plunger 16 is elevated, the main movable contact 19, coupled to the movable plunger 16 by way of the connecting shaft 14, is also elevated, both contact portions 19*a* and 19*b* of the main movable contact 19 come into contact with both contact portions 17*a* and 18*a* of the pair of main fixed contacts 17 and 18, respectively, due to contact pressure from the contact spring 20.

For this reason, a large current from the power supply source is supplied to the load device through the main fixed contact 17 on one side, the main movable contact 19, and the main fixed contact 18 on the other side, and the main contact mechanism 6 is brought to a closed state.

Since, when the main contact mechanism 6 has been brought to a closed state from an open state, the connecting shaft 14, coupled to the movable plunger 16, has also moved to an upper position, the first auxiliary movable contact 28 is brought to a state separated from the first auxiliary fixed contacts 26 and 27, and the first operation detection device confirms non-energization between the first auxiliary contact external terminal portions 51A and 51B. In addition, since the second auxiliary movable contact 36 comes into contact with the second auxiliary fixed contacts 34 and 35, the second operation detection device confirms energization between the second auxiliary contact external terminal portions 51C and 51D.

In the case in which current supply to the load device is cut off while the main contact mechanism 6 is in a closed state, energization to the excitation coil 43 of the electromagnet unit 5 by the electromagnet unit control device is stopped.

When energization to the excitation coil 43 is stopped, disappearance of an excitation force, in the electromagnet unit 5 that moves the movable plunger 16 upward causes the movable plunger 16 to move to a lower position due to a biasing force from the return spring 41, and the connecting shaft 14 also moves to a lower position.

In this operation, there is a case in which an arc generated when the main contact mechanism 6 is brought to an open state from a closed state welds the main movable contact 19 to the pair of main fixed contacts 17 and 18. In such a case, the main movable contact 19 being welded to the pair of main fixed contacts 17 and 18 prevents the connecting shaft 14 from moving downward.

For this reason, with regard to the first auxiliary contact mechanism 7, the connecting shaft 14 not moving downward keeps the first auxiliary movable contact 28 separated from the first auxiliary fixed contacts 26 and 27. Thus, the first operation detection device can confirm non-continuity between the first auxiliary contact external terminal portions 51A and 51B and securely detect an occurrence of welding to the main contact mechanism 6.

Similarly, with regard to the second auxiliary contact mechanism 8, the connecting shaft 14 not moving downward also keeps the second auxiliary movable contact 36 in contact with the second auxiliary fixed contacts 34 and 35. Thus, the second operation detection device can confirm continuity between the second auxiliary contact external terminal portions 51C and 51D and securely detect an occurrence of welding to the main contact mechanism 6.

As described above, according to the electromagnetic contactor 1 of the first embodiment, the main movable contact 19 of the main contact mechanism 6, the first auxiliary movable contact 28 of the first auxiliary contact mechanism 7, and the second auxiliary movable contact 36 of the second auxiliary contact mechanism 8 are directly coupled to the connecting shaft 14, which serves as a movable shaft, and the first operation detection device confirming a continuity state of the first auxiliary contact mechanism 7 and the second operation detection device confirming a continuity state of the second auxiliary contact mechanism 8 make it possible to securely detect an occurrence of welding when the main contact mechanism 6 opens from a closed state.

In addition, only connecting the first operation detection device to the pair of first auxiliary contact external terminal portions 51A and 51B, which are arranged on the front side of the first insulating case 2, and connecting the second operation detection device to the pair of second auxiliary contact external terminal portions 51C and 51D, which are arranged on the front side of the first insulating case 2 in conjunction with the first auxiliary contact external terminal portions 51A and 51B, complete connection work for confirming a continuity state of the first and second auxiliary contact mechanisms 7 and 8. Therefore, it is possible to easily carry out connection work of connecting another electrical component, such as the first and second operation detection devices, that is disposed in a current path to the electromagnetic contactor 1.

Moreover, the wiring patterns 60 to 63, to which four terminals 57 are electrically connected, at four locations are formed on the wiring board 55 composing the auxiliary contact external terminal portion 51 (the pair of first auxiliary contact external terminal portions 51A and 51B and the pair of second auxiliary contact external terminal portions 51C and 51D), the first auxiliary contact electrodes 30 and 31, which project on the front side of the top plate 11 of the housing case 9, are directly connected to the wiring patterns 60 and 61 at two locations, and the second auxiliary contact electrodes 38 and 39, which project on the rear side of the top plate 11 of the housing case 9, are connected to the wiring patterns 62 and 63 at the other two locations by way of the lead wires 73 and 74.

Therefore, mounting the auxiliary contact external terminal portion 51 on the top plate 11 of the housing case 9 requires only connecting the first auxiliary contact electrodes 30 and 31 and the second auxiliary contact electrodes 38 and 39, which project out of the top plate 11, to the wiring board 55, which enables connection work to be carried out easily and efficiently.

Furthermore, since the first auxiliary contact electrodes 30 and 31 are directly connected to the wiring patterns 60 and 61 of the wiring board 55, the number of lead wires that are used in mounting the auxiliary contact external terminal portion 51 has been reduced (to two lead wires 73 and 74), which enables the number of components used in connection work to be reduced.

Next, FIGS. 13 to 19 illustrate structures of second to sixth embodiments for holding lead wires 73 and 74 that extend between an auxiliary contact external terminal portion 51 mounted on a top plate 11 of a housing case 9 and second auxiliary contact electrodes 38 and 39 in an electromagnetic contactor 1. In FIGS. 13 to 17, terminal screws 58 of the auxiliary contact external terminal portion 51 are omitted.

Second Embodiment

Figure 13:
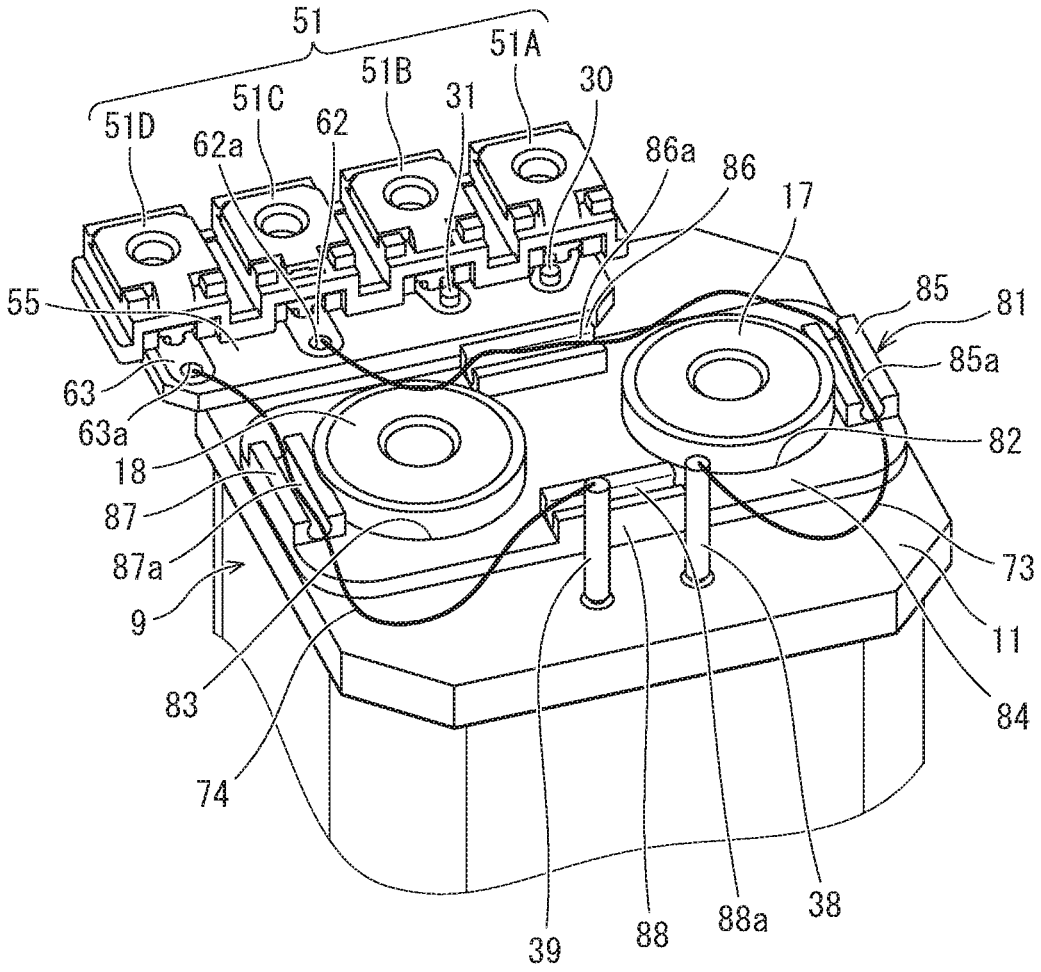
FIG. 13 is a diagram illustrative of a state in which an auxiliary contact external terminal portion is arranged on a case wall in a second embodiment according to the present invention.

As illustrated in FIG. 13, in an electromagnetic contactor 1 of a second embodiment, a lead wire holding portion 81 that is made of an insulating elastic body such as synthetic rubber is arranged on the upper surface of a top plate 11.

The lead wire holding portion 81 includes a mounting plate 84 that has a rectangular shape and on which circular insertion holes 82 and 83 that have substantially the same shapes as the external shapes of main fixed contacts 17 and 18, respectively, are formed, protruding portions 85 to 88 that protrude at four locations and along the edges of the long sides and short sides of and from the upper surface of the mounting plate 84, and holding grooves 85*a* to 88*a* that are respectively formed on the protruding portions 85 to 88 in a linear form.

A lead wire 73 that is connected between a second auxiliary contact electrode 38 and a wiring pattern 62 (a lead wire connection hole 62*a*) of a wiring board 55 extends in a state of having entered and being held in the holding grooves 85*a* and 86*a* of the protruding portions 85 and 86 on the lead wire holding portion 81, which is arranged on the upper surface of the top plate 11. A lead wire 74 that is connected between a second auxiliary contact electrode 39 and a wiring pattern 63 (a lead wire connection hole 63*a*) of the wiring board 55 extends in a state of having entered and being held in the holding groove 87*a* of the protruding portion 87 on the lead wire holding portion 81.

When a contact device 4 is housed inside a first insulating case 2 while the lead wires 73 and 74 are in the above state, an inner wall of the first insulating case 2 comes into proximity to the lead wire holding portion 81 to press and elastically deform the protruding portions 85 to 88, which causes the lead wires 73 and 74 having entered the holding grooves 85*a*, 86*a*, and 87*a* to be clamped.

As described above, in the second embodiment, since each of the lead wires 73 and 74, which are respectively connected between the second auxiliary contact electrodes 38 and 39 and the wiring board 55 of an auxiliary contact external terminal portion 51, enters and is securely held in any of the holding grooves 85*a* to 88*a* of the protruding portions 85 to 88 on the lead wire holding portion 81, which is arranged on the upper surface of the top plate 11, a problem in that the lead wires 73 and 74 get caught between the first insulating case 2 and a second insulating case 3, and the like, when the contact device 4 and an electromagnet unit 5 are put into the first insulating case 2 and the second insulating case 3 may be solved.

In addition, since, when the contact device 4 is housed inside the first insulating case 2, an inner wall of the first insulating case 2 flattens the protruding portions 85 to 88 on the lead wire holding portion 81, the lead wires 73 and 74 in the holding grooves 85*a*, 86*a*, and 87*a* may be securely fixed.

Although, in the second embodiment, a structure in which the protruding portions 85 to 88 protrude on the upper surface of the mounting plate 84 was described, protruding portions may be formed on the lower surface of the mounting plate 84, which comes into contact with the top plate 11 of a housing case 9, and the lead wires 73 and 74 may be put into and held in holding grooves formed on the protruding portions.

Third Embodiment

Figure 14:
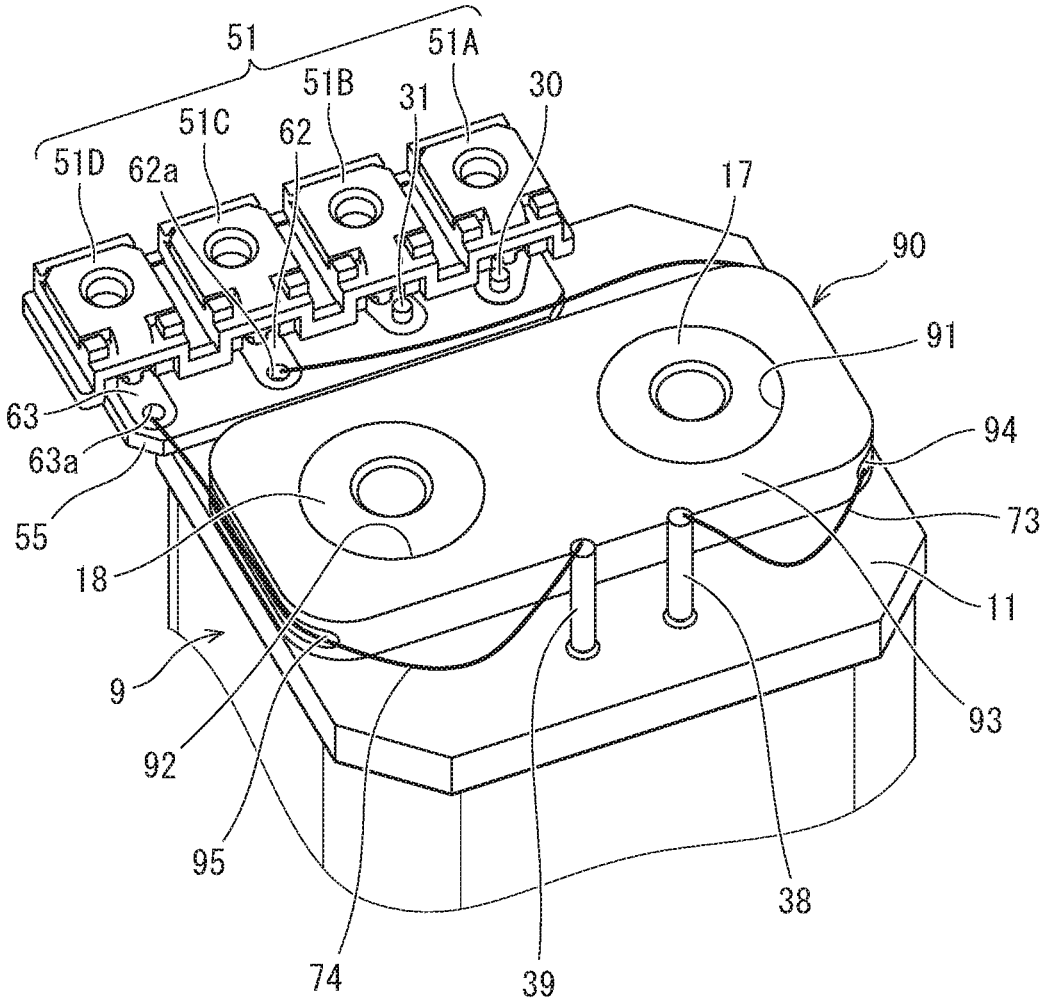
FIG. 14 is a diagram illustrative of a state in which an auxiliary contact external terminal portion is arranged on a case wall in a third embodiment according to the present invention.

As illustrated in FIG. 14, in an electromagnetic contactor 1 of a third embodiment, a lead wire holding portion 90 that is made of an insulating elastic body such as synthetic rubber is arranged on the upper surface of a top plate 11.

The lead wire holding portion 90 includes a mounting plate 93 that has a rectangular shape and a larger thickness than that of the mounting plate 84 in the second embodiment and on which circular insertion holes 91 and 92 that have substantially the same shapes as the external shapes of main fixed contacts 17 and 18, respectively, are formed and holding grooves 94 and 95 that are formed on the short side surfaces of the mounting plate 93.

In the third embodiment, a lead wire 73 that is connected between a second auxiliary contact electrode 38 and a wiring pattern 62 (a lead wire connection hole 62*a*) of a wiring board 55 extends in a state of having entered and being held in the holding groove 94 of the lead wire holding portion 90. In addition, a lead wire 74 that is connected between a second auxiliary contact electrode 39 and a wiring pattern 63 (a lead wire connection hole 63*a*) of the wiring board 55 extends in a state of having entered and being held in the holding groove 95 of the lead wire holding portion 90.

When a contact device 4 is housed inside a first insulating case 2 while the lead wires 73 and 74 are in the above state, an inner wall of the first insulating case 2 comes into proximity to the lead wire holding portion 90 to press and elastically deform the whole of the mounting plate 93, which causes the lead wires 73 and 74 having entered the holding grooves 94 and 95 to be clamped.

As described above, in the third embodiment, since the lead wires 73 and 74 enter and are securely held in the holding grooves 94 and 95 of the lead wire holding portion 90, which is arranged on the upper surface of the top plate 11, a problem in that the lead wires 73 and 74 get caught between the first insulating case 2 and a second insulating case 3, and the like, when the contact device 4 and an electromagnet unit 5 are put into the first insulating case 2 and the second insulating case 3 may be solved.

In addition, since, when the contact device 4 is housed inside the first insulating case 2, an inner wall of the first insulating case 2 flattens the mounting plate 93 of the lead wire holding portion 90, the lead wires 73 and 74 in the holding grooves 94 and 95 may be securely fixed.

Fourth Embodiment

Figure 15:
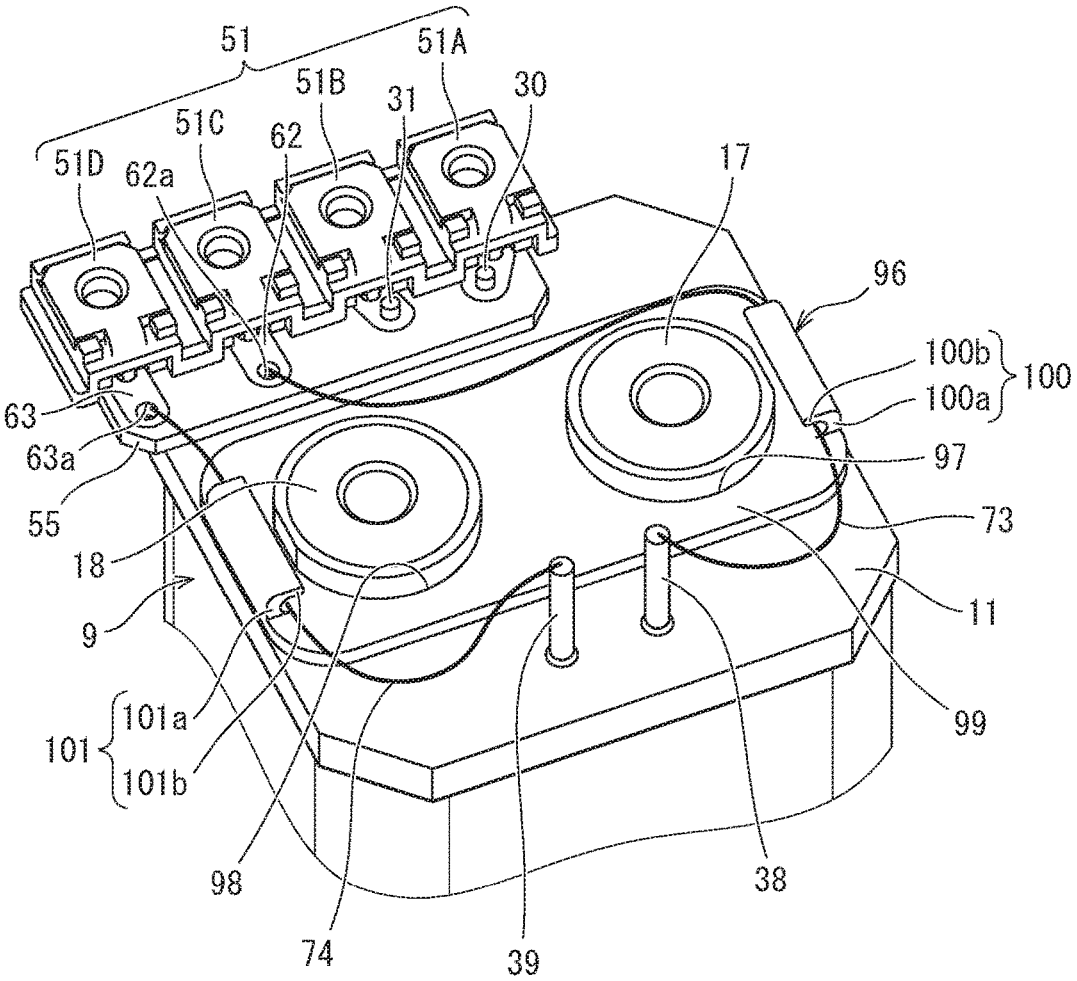
FIG. 15 is a diagram illustrative of a state in which an auxiliary contact external terminal portion is arranged on a case wall in a fourth embodiment according to the present invention.

As illustrated in FIG. 15, in an electromagnetic contactor 1 of a fourth embodiment, a lead wire holding portion 96 that is made of an insulating elastic body such as synthetic rubber is arranged on the upper surface of a top plate 11.

The lead wire holding portion 96 includes a mounting plate 99 that has a rectangular shape and on which circular insertion holes 97 and 98 that have substantially the same shapes as the external shapes of main fixed contacts 17 and 18, respectively, are formed and holding protrusion portions 100 and 101 that are formed along the edges of the short sides of and on the upper surface of the mounting plate 99.

The holding protrusion portions 100 and 101 are L-shaped portions that include rising portions 100*a* and 101*a* that rise up from the upper surface of the mounting plate 99 and bent portions 100*b* and 101*b* that extends from the upper ends of the rising portions 100*a* and 101*a* toward the side where the circular insertion holes 97 and 98 are located, respectively.

In the fourth embodiment, a lead wire 73 that is connected between a second auxiliary contact electrode 38 and a wiring pattern 62 (a lead wire connection hole 62*a*) of a wiring board 55 extends in contact with the inner wall, which faces the main fixed contact 17, of the rising portion 100*a* of the holding protrusion portion 100 on the lead wire holding portion 96.

In addition, a lead wire 74 that is connected between a second auxiliary contact electrode 39 and a wiring pattern 63 (a lead wire connection hole 63*a*) of the wiring board 55 extends in contact with the inner wall, which faces the main fixed contact 18, of the rising portion 101*a* of the holding protrusion portion 101 on the lead wire holding portion 96.

When a contact device 4 is housed inside a first insulating case 2 while the lead wires 73 and 74 are in the above state, an inner wall of the first insulating case 2 comes into proximity to the lead wire holding portion 96 to press the holding protrusion portions 100 and 101 and the rising portions 100*a* and 101*a* and the bent portions 100*b* and 101*b* elastically deform while bending down toward the mounting plate 99. Thus, the lead wires 73 and 74 are clamped by the holding protrusion portions 100 and 101, respectively.

As described above, in the fourth embodiment, since the lead wires 73 and 74 are securely held in the holding protrusion portions 100 and 101 of the lead wire holding portion 96, which is arranged on the upper surface of the top plate 11, a problem in that the lead wires 73 and 74 get caught between the first insulating case 2 and a second insulating case 3, and the like, when the contact device 4 and an electromagnet unit 5 are put into the first insulating case 2 and the second insulating case 3 may be solved.

In addition, since, when the contact device 4 is housed inside the first insulating case 2, an inner wall of the first insulating case 2 flattens the holding protrusion portions 100 and 101 of the lead wire holding portion 96 to make the holding protrusion portions 100 and 101 respectively cover the lead wires 73 and 74, the lead wires 73 and 74 may be securely fixed.

Although, in the fourth embodiment, a structure in which the holding protrusion portions 100 and 101 protrude on the upper surface of the mounting plate 99 was described, the holding protrusion portions 100 and 101 may be formed on the lower surface of the mounting plate 99, which comes into contact with the top plate 11 of a housing case 9.

Fifth Embodiment

Figure 16:
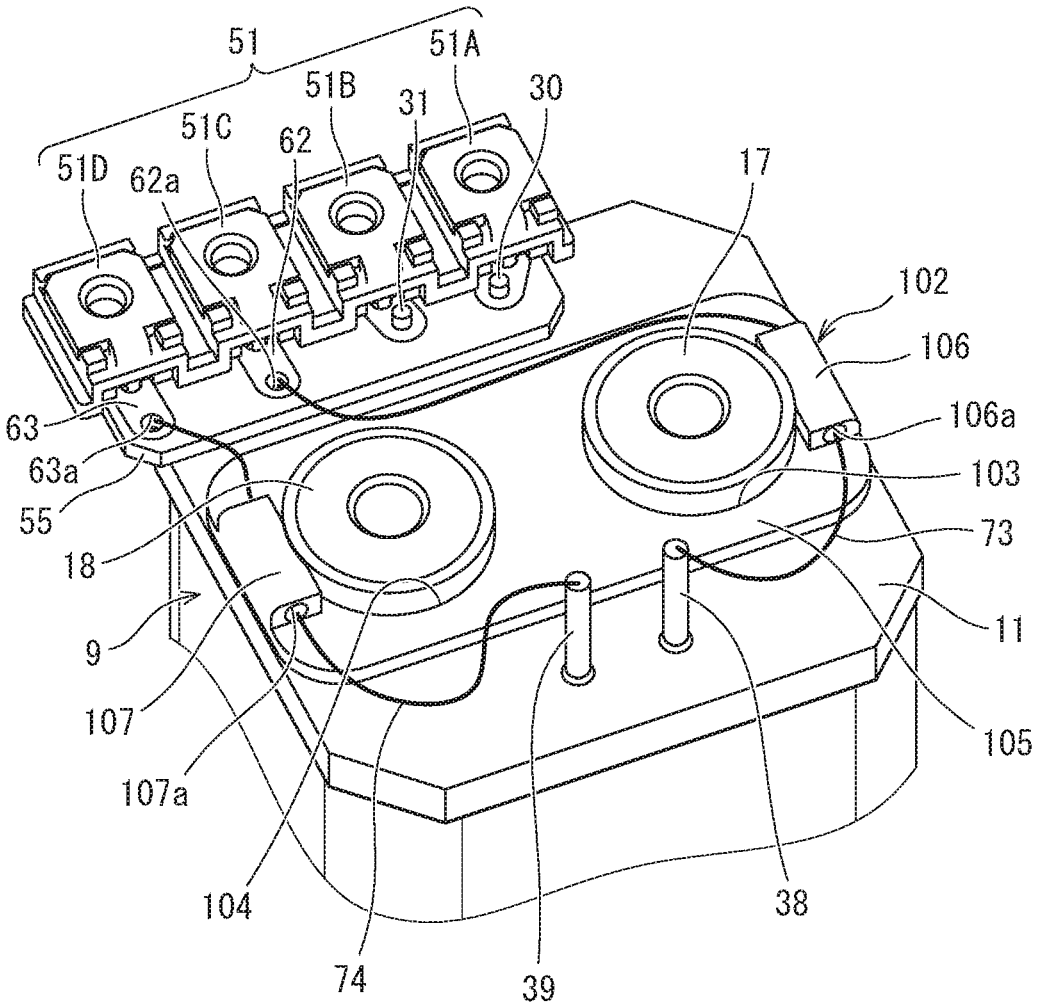
FIG. 16 is a diagram illustrative of a state in which an auxiliary contact external terminal portion is arranged on a case wall in a fifth embodiment according to the present invention.

As illustrated in FIG. 16, in an electromagnetic contactor 1 of a fifth embodiment, a lead wire holding portion 102 that is made of an insulating elastic body such as synthetic rubber is arranged on the upper surface of a top plate 11.

The lead wire holding portion 102 includes a mounting plate 105 that has a rectangular shape and on which circular insertion holes 103 and 104 that have substantially the same shapes as the external shapes of main fixed contacts 17 and 18, respectively, are formed and holding protrusion portions 106 and 107 that are formed along the edges of the short sides of and on the upper surface of the mounting plate 105.

To the holding protrusion portions 106 and 107, through holes 106*a* and 107*a* that penetrate therethrough in the direction along the short sides of the mounting plate 105 and through which lead wires 73 and 74 can be inserted are formed, respectively.

In the fifth embodiment, after the mounting plate 105 of the lead wire holding portion 102 is mounted on the upper surface of the top plate 11, the lead wires 73 and 74 that are neither connected to second auxiliary contact electrodes 38 and 39 nor to a wiring board 55 are respectively inserted through the through holes 106*a* and 107*a* of the holding protrusion portions 106 and 107. Next, the lead wire 73 is connected between the second auxiliary contact electrode 38 and a wiring pattern 62 (a lead wire connection hole 62*a*) of the wiring board 55, and the lead wire 74 is connected between the second auxiliary contact electrode 39 and a wiring pattern 63 (a lead wire connection hole 63*a*) of the wiring board 55.

When a contact device 4 is housed inside a first insulating case 2 while the lead wires 73 and 74 are in the above state, an inner wall of the first insulating case 2 comes into proximity to the lead wire holding portion 102 to press and elastically deform the holding protrusion portions 106 and 107, which causes the lead wires 73 and 74 respectively inserted through the holding protrusion portions 106 and 107 of the lead wire holding portion 102 to be clamped.

As described above, in the fifth embodiment, since the lead wires 73 and 74 are securely held in the holding protrusion portions 106 and 107 of the lead wire holding portion 102, which is arranged on the upper surface of the top plate 11, a problem in that the lead wires 73 and 74 get caught between the first insulating case 2 and a second insulating case 3, and the like, when the contact device 4 and an electromagnet unit 5 are put into the first insulating case 2 and the second insulating case 3 may be solved.

In addition, since, when the contact device 4 is housed inside the first insulating case 2, an inner wall of the first insulating case 2 flattens the holding protrusion portions 106 and 107 of the lead wire holding portion 102, the lead wires 73 and 74 in the holding protrusion portions 106 and 107 may be securely fixed.

Although, in the fifth embodiment, a structure in which the holding protrusion portions 106 and 107 protrude on the upper surface of the mounting plate 105 was described, the holding protrusion portions 106 and 107 may be formed on the lower surface of the mounting plate 105, which comes into contact with the top plate 11 of a housing case 9.

Sixth Embodiment

Figure 17:
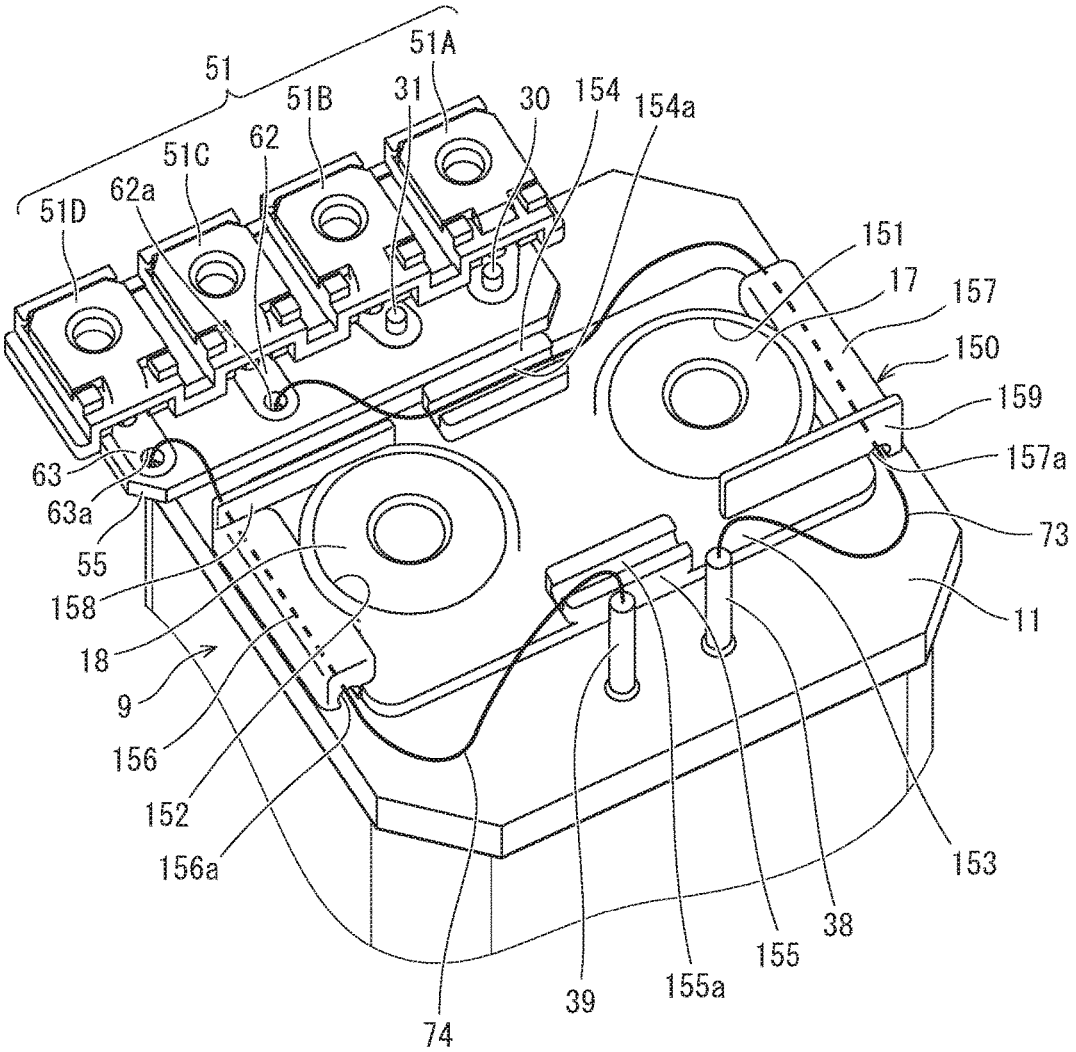
FIG. 17 is a diagram illustrative of a state in which an auxiliary contact external terminal portion is arranged on a case wall in a sixth embodiment according to the present invention.

As illustrated in FIG. 17, in an electromagnetic contactor 1 of a sixth embodiment, a lead wire holding portion 150 that is made of an insulating elastic body such as synthetic rubber is arranged on the upper surface of a top plate 11.

Figure 18A:
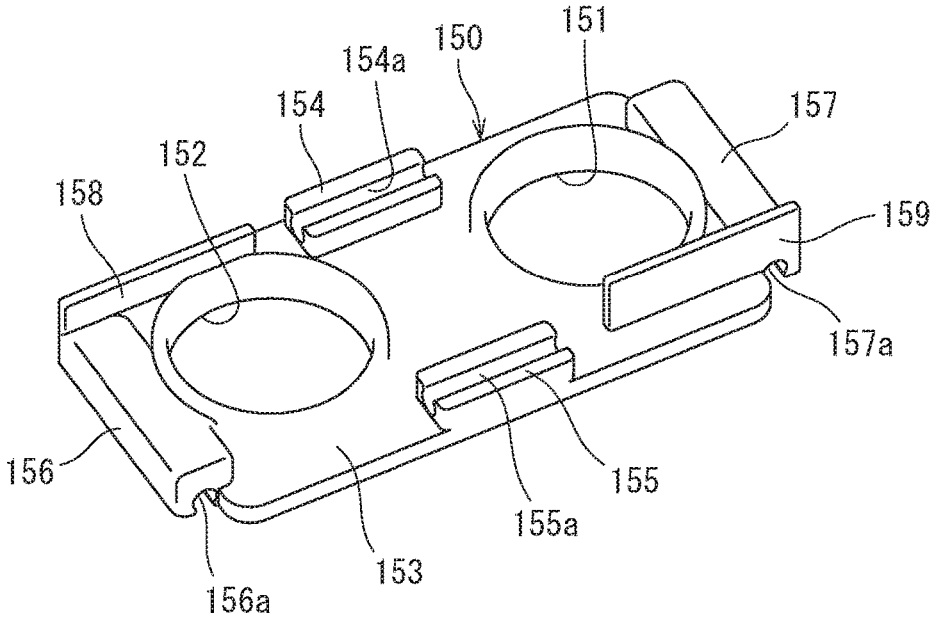
FIGS. 18A and 18B are diagrams illustrative of a lead wire holding portion that is used in the sixth embodiment according to the present invention.
Figure 18B:
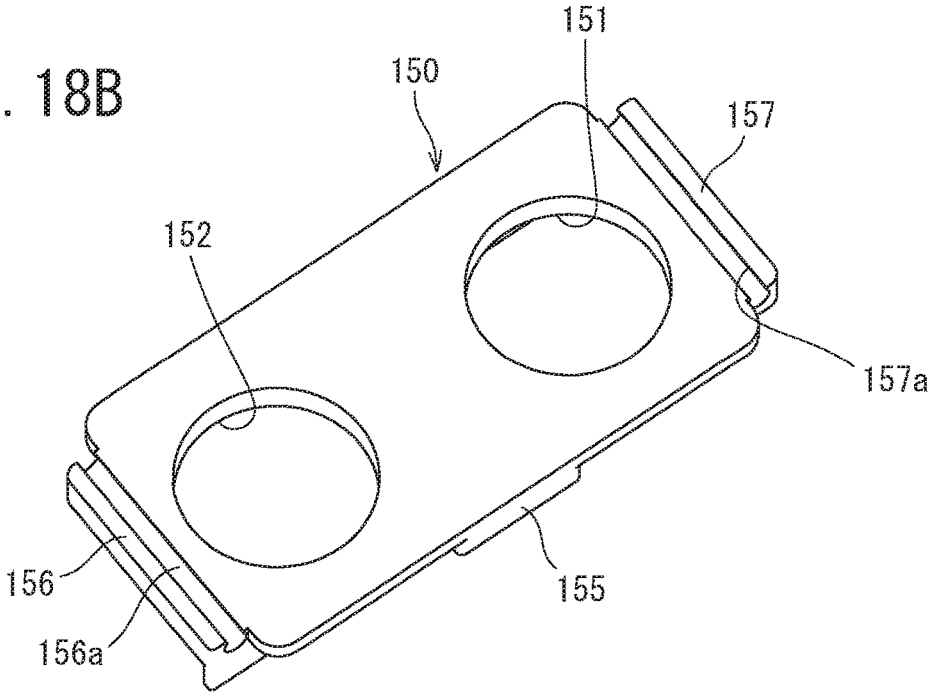

The lead wire holding portion 150 includes a mounting plate 153 that has a rectangular shape and on which circular insertion holes 151 and 152 that have substantially the same shapes as the external shapes of main fixed contacts 17 and 18, respectively, are formed, upper protruding portions 154 and 155 that protrude at two locations and along the edges of the long sides of and from the upper surface of the mounting plate 153, holding grooves 154*a* and 155*a* that are respectively formed on the upper surface of the upper protruding portions 154 and 155 in a linear form, side protruding portions 156 and 157 that protrude outward out of the short sides of the mounting plate 153, holding grooves 156*a* and 157*a* that are respectively formed on the lower surface of the side protruding portions 156 and 157 in a linear form, and a pair of first insulating partition walls 158 and 159 that rise up from the upper surface of the mounting plate 153, as illustrated in FIGS. 18A and 18B.

A lead wire 73 that is connected between a second auxiliary contact electrode 38 and a wiring pattern 62 (a lead wire connection hole 62*a*) of a wiring board 55 extends in a state of having entered and being held in the holding groove 157*a* of the side protruding portion 157 and the holding groove 154*a* of the upper protruding portion 154. A lead wire 74 that is connected between a second auxiliary contact electrode 39 and a wiring pattern 63 (a lead wire connection hole 63*a*) of the wiring board 55 extends in a state of having entered and being held in the holding groove 156*a* of the side protruding portion 156.

In addition, the first insulating partition wall 158 separates the wiring patterns 62 and 63 (the lead wire connection holes 62*a* and 63*a*) to which the lead wires 73 and 74 are respectively connected, on the wiring board 55 from the main fixed contact 18.

When a contact device 4 is housed inside a first insulating case 2 while the lead wires 73 and 74 are in the above state, an inner wall of the first insulating case 2 comes into proximity to the lead wire holding portion 150 to press and elastically deform the upper protruding portion 154 and the side protruding portions 156 and 157. Thus, the lead wires 73 and 74 having entered the holding grooves 156*a* and 157*a* and the holding groove 154*a* are clamped.

In addition, since the first insulating partition wall 158 is arranged between the lead wire connection holes 62*a* and 63*a* to which the lead wires 73 and 74 are respectively connected, and the main fixed contact 18, a sufficient creepage distance for insulation is maintained therebetween.

As described above, in the sixth embodiment, since each of the lead wires 73 and 74 is held in either of the upper protruding portions 154 and 155 and either of the side protruding portions 156 and 157 of the lead wire holding portion 150, which is arranged on the upper surface of the top plate 11, a problem in that the lead wires 73 and 74 get caught between the first insulating case 2 and a second insulating case 3, and the like, when the contact device 4 and an electromagnet unit 5 are put into the first insulating case 2 and the second insulating case 3 may be solved.

In addition, since the first insulating partition wall 158 is located between the lead wire connection hole 62*a* and 63*a* to which the lead wire 73 and 74 are respectively connected, and the main fixed contact 18, a sufficient creepage distance for insulation may be maintained therebetween.

Since the lead wire holding portion 150 has the circular insertion holes 151 and 152, the upper protruding portions 154 and 155, the side protruding portions 156 and 157, and the first insulating partition walls 158 and 159 formed at positions having point symmetry with respect to the center position of the mounting plate 153 as viewed in plan, arrangement of the lead wire holding portion 150 on the upper surface of the top plate 11 may be performed easily.

Figure 19:
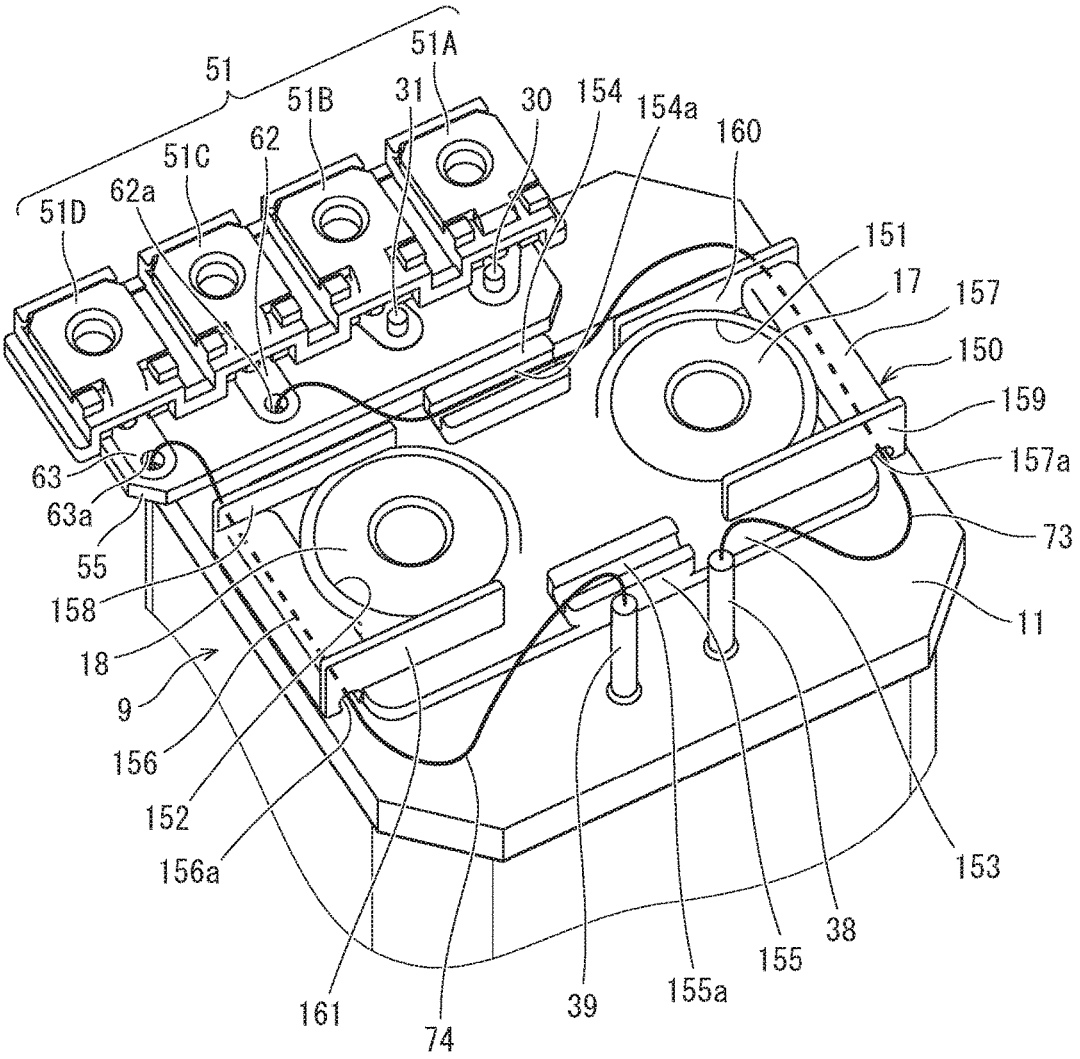
FIG. 19 is a diagram illustrative of a modification example of the sixth embodiment according to the present invention.

FIG. 19 illustrates a modification example of the sixth embodiment, in which, on the upper surface of the mounting plate 153 of the lead wire holding portion 150, a pair of second insulating partition walls 160 and 161 rise up.

The second insulating partition wall 160 rises up between the lead wire 73, which comes out of the holding groove 157*a* of the side protruding portion 157, and the main fixed contact 17. The second insulating partition wall 161 is located between the lead wire 74 on the side where the second auxiliary contact electrode 39 is located and the main fixed contact 18.

Therefore, the second insulating partition wall 160 enables a sufficient creepage distance for insulation to be maintained between the lead wire 73, which comes out of the holding groove 157*a* of the side protruding portion 157, and the main fixed contact 17, and the second insulating partition wall 161 also enables a sufficient creepage distance for insulation to be maintained between the lead wire 74 on the side where the second auxiliary contact electrode 39 is located and the main fixed contact 18.

Seventh Embodiment

Figure 20:
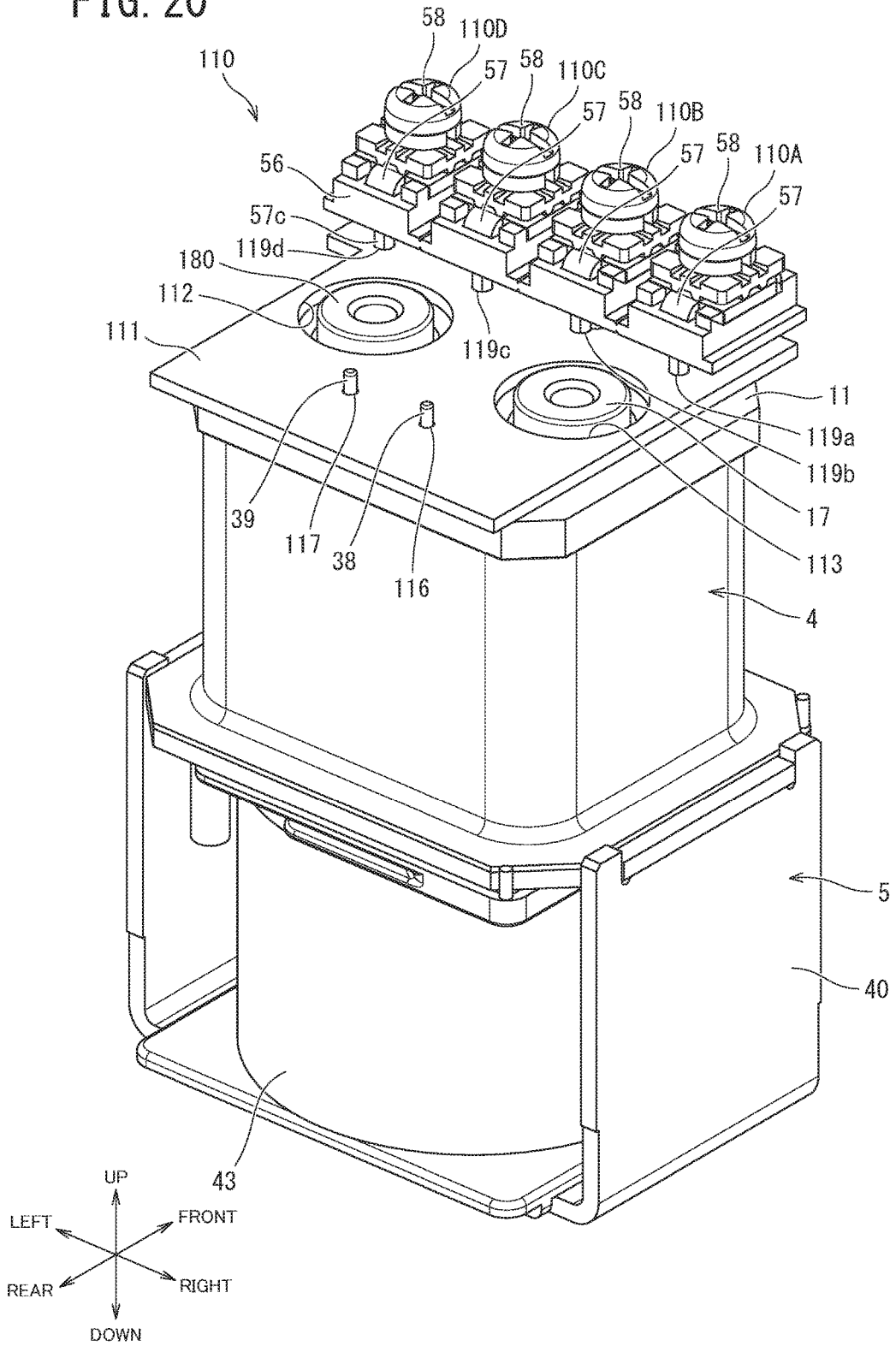
FIG. 20 is a diagram illustrative of a state in which an auxiliary contact external terminal portion is arranged on case wall in a seventh embodiment according to the present invention.
Figure 21:
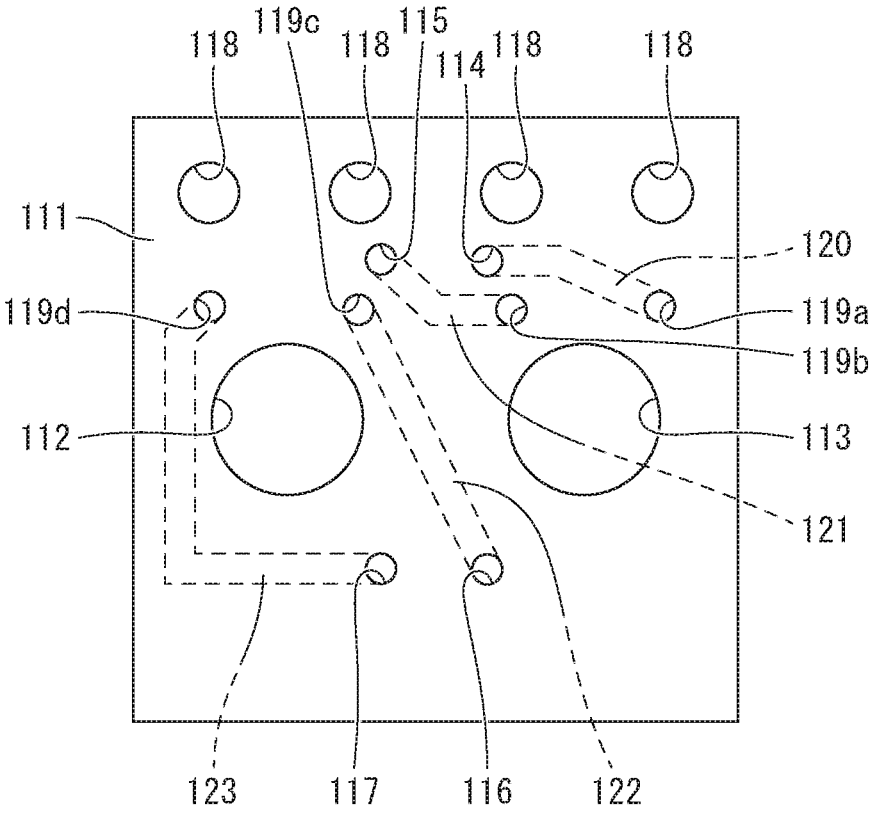
FIG. 21 is a diagram illustrative of wiring patterns of a wiring board composing the auxiliary contact external terminal portion of the seventh embodiment according to the present invention.

Next, FIGS. 20 and 21 illustrate an auxiliary contact external terminal 110 of a seventh embodiment that is arranged on the front side of a top plate 11 of a housing case 9 and connected to first auxiliary contact electrodes 30 and 31 that project on the front side of the top plate 11 and second auxiliary contact electrodes 38 and 39 that project on the rear side of the top plate 11. The same reference signs are assigned to the same components as in the first embodiment illustrated in FIGS. 1 to 12 and a description thereof will be omitted.

The auxiliary contact external terminal 110 includes a wiring board 111 that is mounted on substantially the whole area of the top plate 11, a terminal block 56, four terminals 57, and four terminal screws 58 with a washer.

The wiring board 111 is a square-shaped board that is, for example, formed by impregnating glass fibers with epoxy resin and the like and has substantially the same area as that of the top plate 11.

The wiring board 111 includes circular through holes 112 and 113 into which main fixed contacts 17 and 18 are positioned, first electrode through holes 114 and 115 through which the first auxiliary contact electrodes 30 and 31 are inserted, and second electrode through holes 116 and 117 through which the second auxiliary contact electrodes 38 and 39 are inserted, as illustrated in FIG. 21.

On the side, of the wiring board 111, where the first electrode through holes 114 and 115 are located, large-diameter through holes 118 into which large-diameter legs 66 of the terminal block 56 are fitted are formed at four locations with a predetermined distance between adjacent ones thereof, and terminal through holes 119*a* to 119*d* are also formed at four locations with a predetermined distance between adjacent ones thereof.

On the back surface (the surface facing the top plate 11) of the wiring board 111, a wiring pattern 120 that connects the first electrode through hole 114 and the terminal through holes 119*a* is formed, and a wiring pattern 121 that connects the first electrode through hole 115 and the terminal through hole 119*b* is formed.

In addition, on the back surface of the wiring board 111, a wiring pattern 122 that connects the second electrode through hole 116 and the terminal through hole 119*c* is formed, and a wiring pattern 123 that connects the second electrode through hole 117 and the terminal through hole 119*d* is formed.

The terminal block 56 is engaged with the wiring board 111 by the large-diameter legs 66 at four locations being inserted into the large-diameter through holes 118 of the wiring board 111.

Connection pieces 57*c* of four terminals 57 are press-fitted through connection piece press-fit holes 68 at four locations of the terminal block 56 and are subsequently inserted into and soldered to the terminal through holes 119*a* to 119*d* at four locations of the wiring board 111 to be connected to the wiring board 111.

The first auxiliary contact electrodes 30 and 31 that are respectively inserted into the first electrode through holes 114 and 115 of the wiring board 111, and the second auxiliary contact electrodes 38 and 39 that are respectively inserted into the second electrode through holes 116 and 117 of the wiring board 111, are connected by soldering.

Therefore, as illustrated in FIG. 20, in the auxiliary contact external terminal 110 of the seventh embodiment, a pair of combinations of a terminal 57 and a terminal screw 58 on the right side are used as first auxiliary contact external terminal portions 110A and 110B that serve as the external terminals of a first auxiliary contact mechanism 7, and a pair of combinations of a terminal 57 and a terminal screw 58 on the left side are used as second auxiliary contact external terminal portions 110C and 110D that serve as the external terminals of a second auxiliary contact mechanism 8.

As described above, according to the seventh embodiment, since the wiring board 111, which composes the auxiliary contact external terminal 110 and the wiring patterns 120 and 121 of which directly connect the first auxiliary contact electrodes 30 and 31, respectively, and the wiring patterns 122 and 123 of which directly connect the second auxiliary contact electrodes 38 and 39, respectively, eliminates the necessity of a lead wire, connection work relating to the auxiliary contact external terminal 110 may be carried out more efficiently and a reduction in the number of components used in the connection work may be facilitated.

Eighth Embodiment

Figure 22:
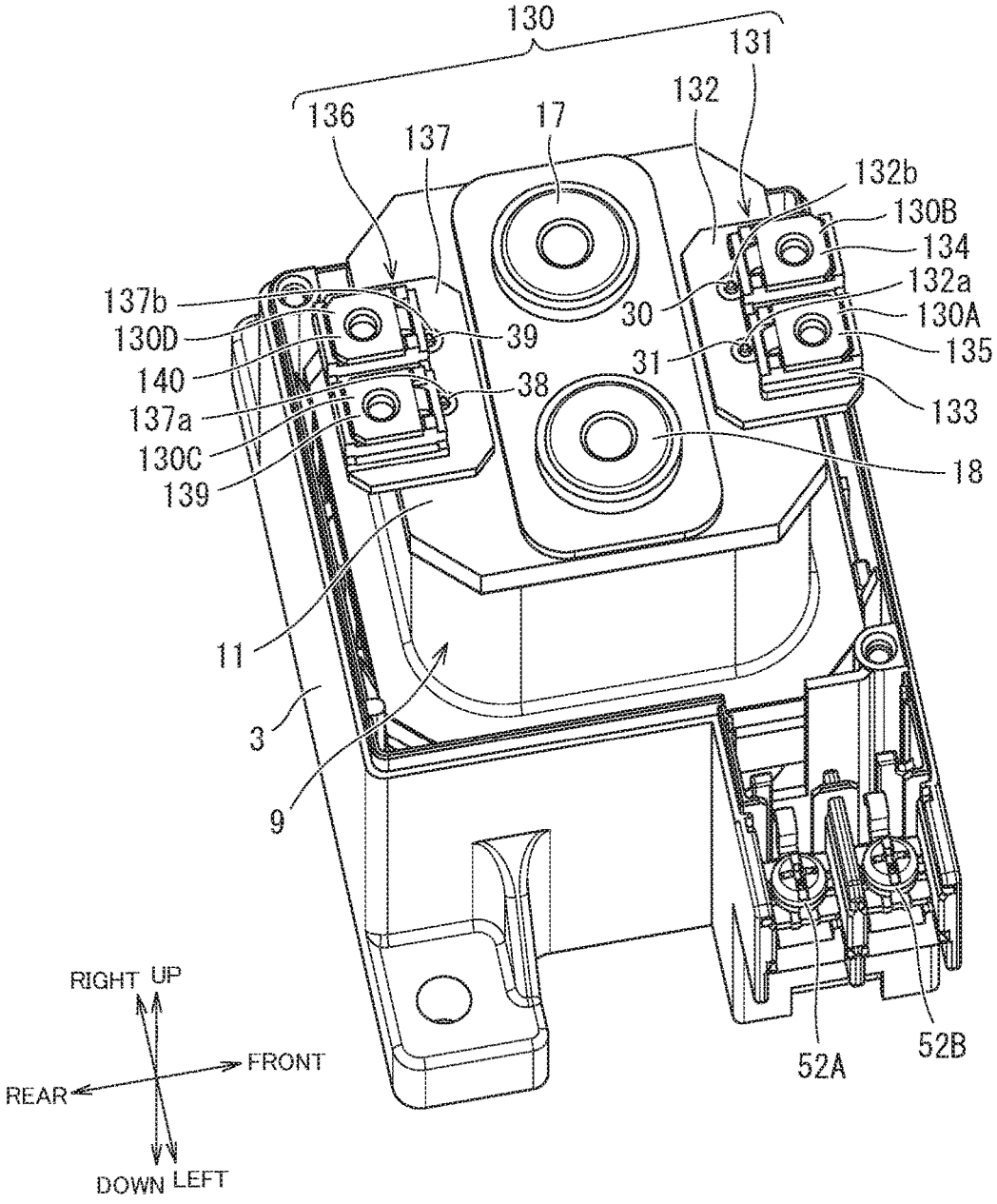
FIG. 22 is a diagram illustrative of a state in which auxiliary contact external terminal portions are arranged on a case wall in an eighth embodiment according to the present invention.

Next, FIG. 22 illustrates an auxiliary contact external terminal portion 130 of an eighth embodiment that is connected to first auxiliary contact electrodes 30 and 31 on the front side of a top plate 11 and to second auxiliary contact electrodes 38 and 39 on the rear side of the top plate 11.

The auxiliary contact external terminal portion 130 of the eighth embodiment includes an auxiliary contact external terminal portion 131 arranged on the front side of the top plate 11 and an auxiliary contact external terminal portion 136 arranged on the rear side of the top plate 11.

The auxiliary contact external terminal portion 131 includes a wiring board 132 on which wiring patterns 132*a* and 132*b* at two locations are formed and two terminals 134 and 135 that are supported by a terminal block 133 and the terminal connection pieces (not illustrated) of which are respectively inserted into and connected to terminal insertion holes (not illustrated) at two locations that are formed in the wiring patterns 132*a* and 132*b*. The first auxiliary contact electrodes 30 and 31 that project on the front side of the top plate 11 are respectively inserted into and connected to electrode passage holes (not illustrated) formed in the wiring patterns 132*a* and 132*b*.

The other auxiliary contact external terminal portion 136 also includes a wiring board 137 on which wiring patterns 137*a* and 137*b* at two locations are formed and two terminals 139 and 140 that are supported by a terminal block 138 and the terminal connection pieces (not illustrated) of which are respectively inserted into and connected to terminal insertion holes (not illustrated) at two locations that are formed in the wiring patterns 137*a* and 137*b*. The second auxiliary contact electrodes 38 and 39 that project on the rear side of the top plate 11 are respectively inserted into and connected to electrode passage holes (not illustrated) formed in the wiring patterns 137*a* and 137*b*.

In the auxiliary contact external terminal portion 130 of the eighth embodiment, the auxiliary contact external terminal portion 131 that is arranged on the front side of the top plate 11 is used as first auxiliary contact external terminal portions 130A and 130B that serve as the external terminals of a first auxiliary contact mechanism 7, and the auxiliary contact external terminal portion 136 that is arranged on the rear side of the top plate 11 is used as second auxiliary contact external terminal portions 130C and 130D that serve as the external terminals of a second auxiliary contact mechanism 8.

Therefore, according to the eighth embodiment, since the necessity of a lead wire is eliminated by the first auxiliary contact electrodes 30 and 31 being directly connected to the wiring patterns 132*a* and 132*b* of the first auxiliary contact external terminal portions 130A and 130B, respectively, and the second auxiliary contact electrodes 38 and 39 being directly connected to the wiring patterns 137*a* and 137*b* of the second auxiliary contact external terminal portions 130C and 130D, respectively, connection work relating to the auxiliary contact external terminal portion 130 may be carried out more efficiently and a reduction in the number of components used in the connection work may be facilitated.

Ninth Embodiment

Figure 23:
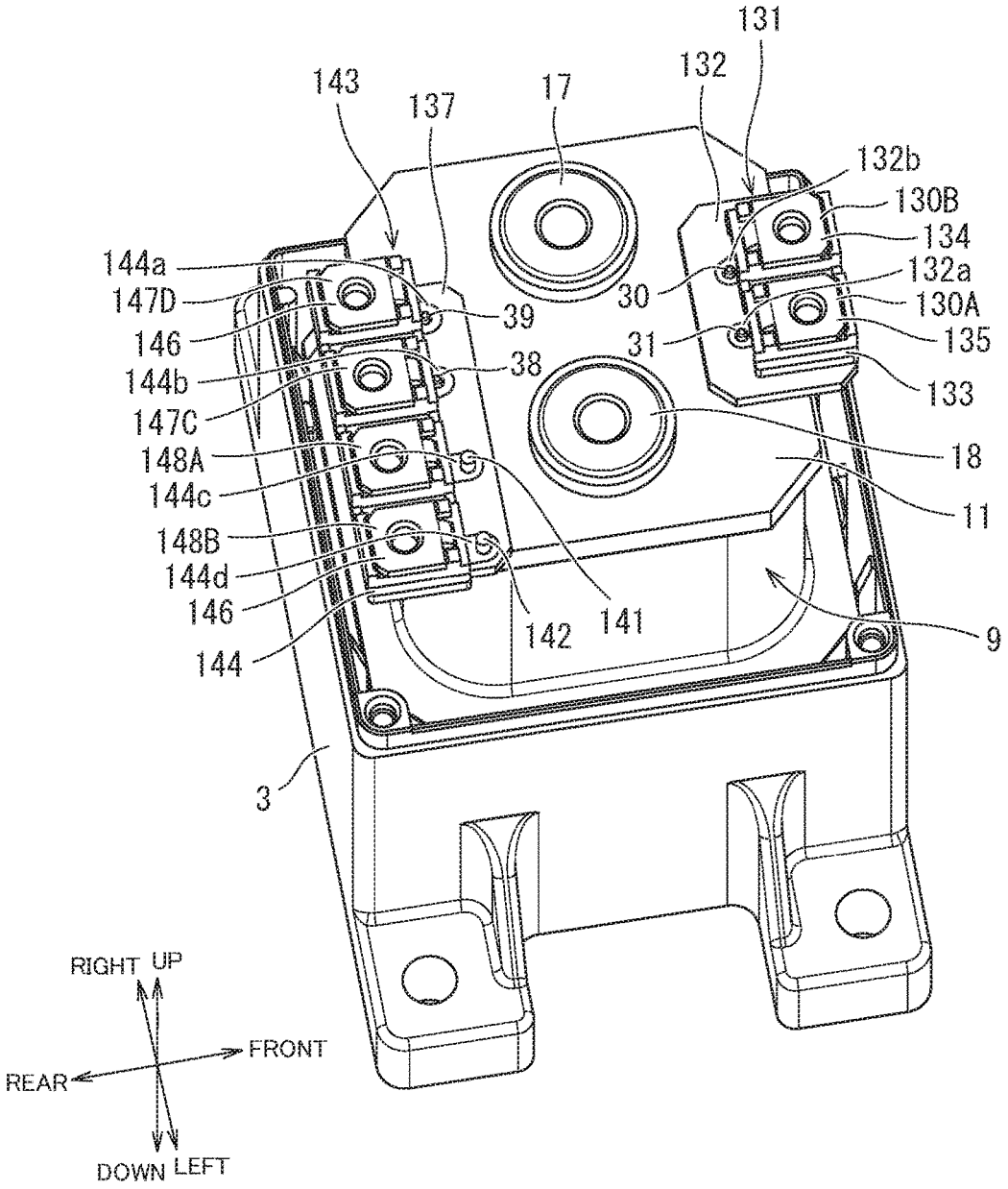
FIG. 23 is a diagram illustrative of a state in which auxiliary contact external terminal portions and an electromagnet unit external terminal portion are arranged on a case wall in a ninth embodiment according to the present invention.

Furthermore, in a ninth embodiment illustrated in FIG. 23, a pair of electromagnet unit electrodes 141 and 142 that are respectively connected to the two ends of the winding of an excitation coil 43 of an electromagnet unit 5 project on the rear side of a top plate 11 and in proximity to second auxiliary contact electrodes 38 and 39.

In addition, an auxiliary contact external terminal portion 131 is arranged on the front side of the top plate 11, and a second auxiliary contact/electromagnet unit external terminal portion 143 is arranged on the rear side of the top plate 11.

Assuming that the auxiliary contact external terminal portion 131 has the same configuration as that of the auxiliary contact external terminal portion 131 illustrated in FIG. 22 in the eighth embodiment and is configured as first auxiliary contact external terminal portions 130A and 130B that serve as the external terminals of a first auxiliary contact mechanism 7, the same reference signs are assigned to the same components and a description thereof will be omitted.

The second auxiliary contact/electromagnet unit external terminal portion 143 includes a wiring board 144 on which wiring patterns 144*a* to 144*d* at four locations are formed and four terminals 146 that are supported by a terminal block 145 and the terminal connection pieces (not illustrated) of which are respectively inserted into and connected to terminal insertion holes (not illustrated) formed in the wiring patterns 144*a* to 144*d* at four locations The second auxiliary contact electrodes 38 and 39 that project on the rear side of the top plate 11 are respectively inserted into and connected to electrode passage holes that are formed in the wiring patterns 144*a* and 144*b* at two locations on the right side of the second auxiliary contact/electromagnet unit external terminal portion 143, and two terminals 146 on the right side of the second auxiliary contact/electromagnet unit external terminal portion 143 are configured as second auxiliary contact external terminal portions 147C and 147D that serve as the external terminals of a second auxiliary contact mechanism 8.

On the other hand, the pair of electromagnet unit electrodes 141 and 142 are respectively inserted into and connected to electrode passage holes formed in the wiring patterns 144*c* and 144*d* at two locations on the left side of the second auxiliary contact/electromagnet unit external terminal portion 143.

Therefore, two terminals 146 on the left side of the second auxiliary contact/electromagnet unit external terminal portion 143 are used as electromagnet unit external terminal portions 148A and 148B.

According to the ninth embodiment, since, in conjunction with the first auxiliary contact external terminal portions 130A and 130B and the second auxiliary contact external terminal portions 147C and 147D, the electromagnet unit external terminal portions 148A and 148B are configured to be arranged on the top plate 11, connection work of connecting another electrical component disposed in a current path and an electromagnetic contactor 1 may be performed more easily.

When a structure in which, by the auxiliary contact external terminal portion 131 being also arranged on the rear side of the top plate 11, all the auxiliary contact external terminal portion 131 and the second auxiliary contact/electromagnet unit external terminal portion 143 are convergently arranged at one side on the rear side of the top plate 11 is employed as another structure different from the ninth embodiment, connection work of connecting another electrical component disposed in a current path and the electromagnetic contactor 1 may be performed more easily as with the ninth embodiment.

In the above-described first to ninth embodiments, a main contact portion according to the present invention corresponds to the main contact mechanism 6, auxiliary contact portions according to the present invention correspond to the first and second auxiliary contact mechanisms 7 and 8, and a contact housing case according to the present invention corresponds to and the housing case 9. In addition, auxiliary contact electrodes according to the present invention correspond to the first auxiliary contact electrodes 30 and 31 and the second auxiliary contact electrodes 38 and 39. Further, wire holding portions according to the present invention correspond to the lead wire holding portion 81, 90, 96, 102, and 150. Furthermore, L-shaped protruding portions according to the present invention correspond to the holding protrusion portions 100 and 101. Moreover, partition walls according to the present invention correspond to the first insulating partition walls 158 and 159 and the second insulating partition walls 160 and 161.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

REFERENCE SIGNS LIST

1 Electromagnetic contactor
2 First insulating case
3 Second insulating case
4 Contact device
5 Electromagnet unit
6 Main contact mechanism
7, 8 First and second auxiliary contact mechanisms
9 Housing case
10 Joining member
11 Top plate
12 Magnetic yoke
12*a* Through hole
13 Cap
14 Connecting shaft
14*a* First connecting shaft
14*b* Second connecting shaft
14*c* Shaft coupling member
14*d* Flange portion
15 Fixed iron core
15*a*, 16*a* Return spring housing recessed portion
16 Movable plunger
17, 18 Main fixed contact
19 Main movable contact
17*a*, 18*a* Contact portion
17*b*, 18*b* Female screw
19*a* Contact portion
19*b* Contact portion
20 Contact spring
21 Main contact mechanism housing chamber
22 Arc-extinguishing container
23 Auxiliary contact mechanism housing chamber
24 First auxiliary fixed contact support member
25 First auxiliary movable contact support member
26, 27 First auxiliary fixed contact

26*a* Contact plate
26*b* Electrode connection plate
27*b* Electrode connection plate
28 First auxiliary movable contact
29 Biasing spring
30, 31 First auxiliary contact electrode
32 Second auxiliary fixed contact support member
33 Second auxiliary movable contact support member
34, 35 Second auxiliary fixed contact
36 Second auxiliary movable contact
37 Biasing spring
38, 39 Second auxiliary contact electrode
40 Lower magnetic yoke
41 Return spring
42 Spool
43 Excitation coil
50*a*, 50*b* Main contact external terminal portion
51 Auxiliary contact external terminal portion
51A, 51B First auxiliary contact external terminal portion
51C, 51D Second auxiliary contact external terminal portion
52A, 52B Electromagnet unit external terminal portion
55 Wiring board
56 Terminal block
57 Terminal
58 Terminal screw
60 to 63 Wiring pattern
60*a*, 61*a* Electrode passage hole
60*b*, 61*b* Terminal passage hole
62*a*, 63*a* Lead wire connection hole
62*b*, 63*b* Terminal passage hole
64 Small-diameter through hole
65 Large-diameter through hole
57*a* Threaded hole
57*b* Terminal plate
57*c* Connection piece
66 Large-diameter leg
67 Small-diameter leg
68 Connection piece press-fit hole
69 Terminal plate support surface
71 Soldered portion
72 Soldered portion
73, 74 Lead wire
80 Captive screw
81 Lead wire holding portion
82, 83 Circular insertion hole
84 Mounting plate
85 to 88 Protruding portion
85*a* to 88*a* Holding groove
90 Lead wire holding portion
91, 92 Circular insertion hole
93 Mounting plate
94, 95 Holding groove
96 Lead wire holding portion
97, 98 Circular insertion hole
99 Mounting plate
100, 101 Holding protrusion portion
100*a*, 101*a* Rising portion
100*b*, 101*b* Bent portion
102 Lead wire holding portion
103, 104 Circular insertion hole
105 Mounting plate
106, 107 Holding protrusion portion
106*a*, 107*a* Through hole
110 Auxiliary contact external terminal
110A, 110B First auxiliary contact external terminal portion
110C, 110D Second auxiliary contact external terminal portion
111 Wiring board
112, 113 Circular through hole
114, 115 First electrode through hole
116, 117 Second electrode through hole
118 Large-diameter through hole
119*a* to 119*d* Terminal through hole
120 to 123 Wiring pattern
130 Auxiliary contact external terminal portion
132*a*, 132*b*, 137*a*, 137*b* Wiring pattern
132, 137 Wiring board
133, 138 Terminal block
134, 135, 139, 140 Terminal
130A, 130B First auxiliary contact external terminal portion
130C, 130D Second auxiliary contact external terminal portion
141, 142 Electromagnet unit electrode
143 Second auxiliary contact/electromagnet unit external terminal portion
144 Wiring board
144*a* to 144*d* Wiring pattern
146 Terminal
147C, 147D Second auxiliary contact external terminal portion
148A, 148B Electromagnet unit external terminal portion
150 Lead wire holding portion
151, 152 Circular through hole
153 Mounting plate
154, 155 Upper protruding portion
154*a*, 155*a* Holding groove
156, 157 Side protruding portion
156*a*, 157*a* Holding groove
158, 159 First insulating partition wall
160, 161 Second insulating partition wall

The invention claimed is:

1. An electromagnetic contactor comprising:

a main contact mechanism;

an auxiliary contact mechanism that includes a plurality of pairs of fixed contacts and operates in conjunction with the main contact mechanism;

a contact housing case that includes a case wall, and houses the main contact mechanism and the auxiliary contact mechanism;

an electromagnet unit that drives the main contact mechanism and the auxiliary contact mechanism;

a plurality of pairs of auxiliary contact electrodes that is connected to the plurality of pairs of fixed contacts of the auxiliary contact mechanism and projects out of the case wall;

a plurality of pairs of auxiliary contact external terminal portions that is arranged on the case wall;

a plurality of wires connecting one of the plurality of pairs of auxiliary contact electrodes and one of the plurality of pairs of auxiliary contact external terminal portions;

a wiring holding portion including a mounting plate that is mounted on the case wall, and a wiring fixing portion that is formed on the mounting plate to fix a part of each of the plurality of wires the wiring holding portion being made of an elastic body;

a first insulating case that houses the contact housing case and the wiring holding portion in a state wherein the wiring fixing portion elastically deforms; and a second insulating case that houses the electromagnet unit.

2. The electromagnetic contactor according to claim 1, wherein another of the plurality of pairs of auxiliary contact external terminal portions is fixed to another of the plurality of pairs of auxiliary contact electrodes.

3. The electromagnetic contactor according to claim 2, wherein the one of the plurality of pairs of auxiliary contact electrodes is not fixed to the another of the plurality of pairs of auxiliary contact external terminal portions.

4. The electromagnetic contactor according to claim 3, wherein the plurality of pairs of auxiliary contact external terminal portions is convergently arranged at least at one side of the contact housing case.

5. The electromagnetic contactor according to claim 1, wherein the plurality of pairs of auxiliary contact external terminal portions comprises:

terminals; and a wiring board on which wiring patterns that electrically connect the terminals and the plurality of pairs of auxiliary contact electrodes are formed.

6. The electromagnetic contactor according to claim 5, wherein the wiring board that electrically connects the plurality of pairs of auxiliary contact electrodes is made up of a single board.

7. The electromagnetic contactor according to claim 5, wherein the plurality of pairs of auxiliary contact external terminal portions is separated into at least two sections.

8. The electromagnetic contactor according to claim 7, wherein the electromagnet unit further comprises an electromagnet unit external terminal portion, and the electromagnet unit external terminal portion is formed on a same surface on which the plurality of pairs of auxiliary contact external terminal portions is formed.

9. The electromagnetic contactor according to claim 8, wherein the electromagnet unit external terminal portion is convergently arranged at least at one side of the contact housing case in conjunction with the plurality of pairs of auxiliary contact external terminal portions.

10. The electromagnetic contactor according to claim 1, wherein the wiring fixing portion is a protruding portion formed on the wire holding portion.

11. The electromagnetic contactor according to claim 10, wherein a holding groove is formed on the protruding portion.

12. The electromagnetic contactor according to claim 10, wherein the protruding portion is L-shaped.

13. The electromagnetic contactor according to claim 10, wherein a through hole is formed in the protruding portion.

14. The electromagnetic contactor according to claim 1, wherein a holding groove is formed on a side surface of the wire holding portion.

15. The electromagnetic contactor according to claim 1, wherein a holding groove is formed on a lower surface of the wire holding portion.

16. The electromagnetic contactor according to claim 1, further comprising:

a partition wall between the main contact mechanism and the plurality of pairs of auxiliary contact external terminal portions or between the main contact mechanism and the plurality of wires.

17. The electromagnetic contactor according to claim 1, wherein a partition wall is formed on the wire holding portion.

18. The electromagnetic contactor according to claim 1, wherein an elastic plate for vibration absorption also serves as the wire holding portion.

* * * * *